US010719047B2

(12) United States Patent
Seki

(10) Patent No.: US 10,719,047 B2
(45) Date of Patent: Jul. 21, 2020

(54) IMAGE FORMING APPARATUS

(71) Applicant: CANON KABUSHIKI KAISHA, Tokyo (JP)

(72) Inventor: Yuichi Seki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/570,946

(22) Filed: Sep. 13, 2019

(65) Prior Publication Data

US 2020/0096931 A1 Mar. 26, 2020

(30) Foreign Application Priority Data

Sep. 21, 2018 (JP) ..... 2018-177522

(51) Int. Cl.
*G03G 15/00* (2006.01)
*G03G 21/00* (2006.01)
*G03G 21/02* (2006.01)

(52) U.S. Cl.
CPC ..... *G03G 21/007* (2013.01); *G03G 15/505* (2013.01); *G03G 15/5045* (2013.01); *G03G 21/02* (2013.01)

(58) Field of Classification Search
CPC ..... G03G 15/5008; G03G 15/5054; G03G 15/505; G03G 21/007; G03G 21/02; G03G 21/0076; G03G 2221/011
USPC ..... 399/1–4, 38, 42, 43, 46, 71
See application file for complete search history.

(56) References Cited

U.S. PATENT DOCUMENTS 7,729,641 B2 * 6/2010 Suzuki ..... G03G 15/0808 399/119
9,568,861 B2 * 2/2017 Kitabayashi ..... G03G 15/161

FOREIGN PATENT DOCUMENTS

JP 2016-31467 A 3/2016

* cited by examiner

*Primary Examiner* — Hoan H Tran
(74) *Attorney, Agent, or Firm* — Canon U.S.A., Inc. IP Division

(57) ABSTRACT

An apparatus includes a forming unit, a cleaning mechanism that cleans a transparent member of a scanning device of the forming unit, a counter that counts a number of image-formed sheets, which are sheets of a recording medium on which images have been formed by the forming unit, the counter performing counting with a first count value in a case where the forming unit performs image formation in a first mode and performing counting with a second count value larger than the first count value in a case where the forming unit performs image formation in a second mode higher in image forming speed than the first mode, and a control unit that controls the cleaning mechanism to clean the transparent member in response to the number of image-formed sheets counted by the counter reaching a predetermined number of sheets.

9 Claims, 13 Drawing Sheets

IMAGE FORMING APPARATUS

BACKGROUND OF THE INVENTION

Field of the Invention

Aspects of the embodiments generally relate to an image forming apparatus, such as an electrophotographic copying machine or a laser beam printer, which forms an image on a recording medium with use of an electrophotographic method.

Description of the Related Art

A conventional image forming apparatus employing an electrophotographic method is equipped with an optical scanning device, which radiates laser light onto the surface of an electrically charged photosensitive member to form an electrostatic latent image on the photosensitive member. The optical scanning device includes optical system components, such as a light source and a mirror, a casing, which covers the optical system components, and an opening portion, through which light from the light source is output to outside the casing. Then, the opening portion is occluded by a transparent member, which allows light to pass therethrough, for the purpose of preventing a foreign substance such as toner or dust from intruding into the casing.

Here, in a case where a foreign substance, such as toner or dust, is present on the transparent member, light which is output through the opening portion is blocked by the foreign substance, so that a change in optical property occurs in the optical scanning device and, as a result, the quality of an image which is formed on a recording medium may decrease.

In this regard, Japanese Patent Application Laid-Open No. 2016-31467 discusses a configuration which performs a cleaning operation to remove a foreign substance present on the transparent member with a cleaning member by moving the cleaning member while keeping the cleaning member in contact with the surface of the transparent member. Moreover, Japanese Patent Application Laid-Open No. 2016-31467 discusses a configuration which performs the above-mentioned cleaning operation on a periodic basis each time, for example, image formation on about 10,000 sheets is performed.

Here, some conventional image forming apparatuses are configured to vary an image forming speed depending on contents of an image forming job, such as the type of a recording medium or the setting of an image quality. For example, in the case of performing image formation on heavy paper, such image forming apparatuses may make the conveyance speed of a recording medium lower or make the image forming speed lower by decreasing the circumferential speed of a photosensitive member or an intermediate transfer belt than in the case of performing image formation on plain paper. This is because the amount of heat used to fix a toner image to heavy paper is greater than the amount of heat used to fix a toner image to plain paper.

At this time, the amount of scattering of a foreign substance such as toner varies between a case where the image forming speed is high and a case where the image forming speed is low. For example, in a case where the image forming speed is high, since the rotational speed of, for example, a photosensitive drum or a developing unit is higher than in a case where the image forming speed is low, toner becomes more likely to scatter due to, for example, centrifugal force caused by the rotation of the developing unit. Therefore, if the image forming apparatus determines timing at which to perform a cleaning operation only according to the number of image-formed sheets, the timing at which to perform a cleaning operation may not be appropriate in some cases.

SUMMARY OF THE INVENTION

According to an aspect of the embodiments, an apparatus includes a forming unit including a photosensitive member, a scanning device including a transparent member which allows laser light for scanning the photosensitive member to pass therethrough outward, and a sleeve which develops, with toner, an electrostatic latent image formed on the photosensitive member scanned by the laser light into a toner image, and configured to form an image on a recording medium by transferring the toner image to the recording medium, the forming unit performing image formation on the recording medium in a first mode in which image formation is performed with a rotational speed of the photosensitive member set to a first speed or in a second mode in which image formation is performed with the rotational speed of the photosensitive member set to a second speed higher than the first speed, a cleaning mechanism configured to clean the transparent member, a counter configured to count a number of image-formed sheets, which are sheets of the recording medium on which images have been formed by the forming unit, the counter performing counting with a first count value in a case where the forming unit performs image formation in the first mode and performing counting with a second count value larger than the first count value in a case where the forming unit performs image formation in the second mode, and a control unit configured to control the cleaning mechanism to clean the transparent member in response to the number of image-formed sheets counted by the counter reaching a predetermined number of sheets.

Further features of the disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. Furthermore, for example, the dimension, material, shape, and relative location of each constituent component described in the following description are, unless specifically described, not intended to limit the scope of the disclosure only thereto.

Figure 1:
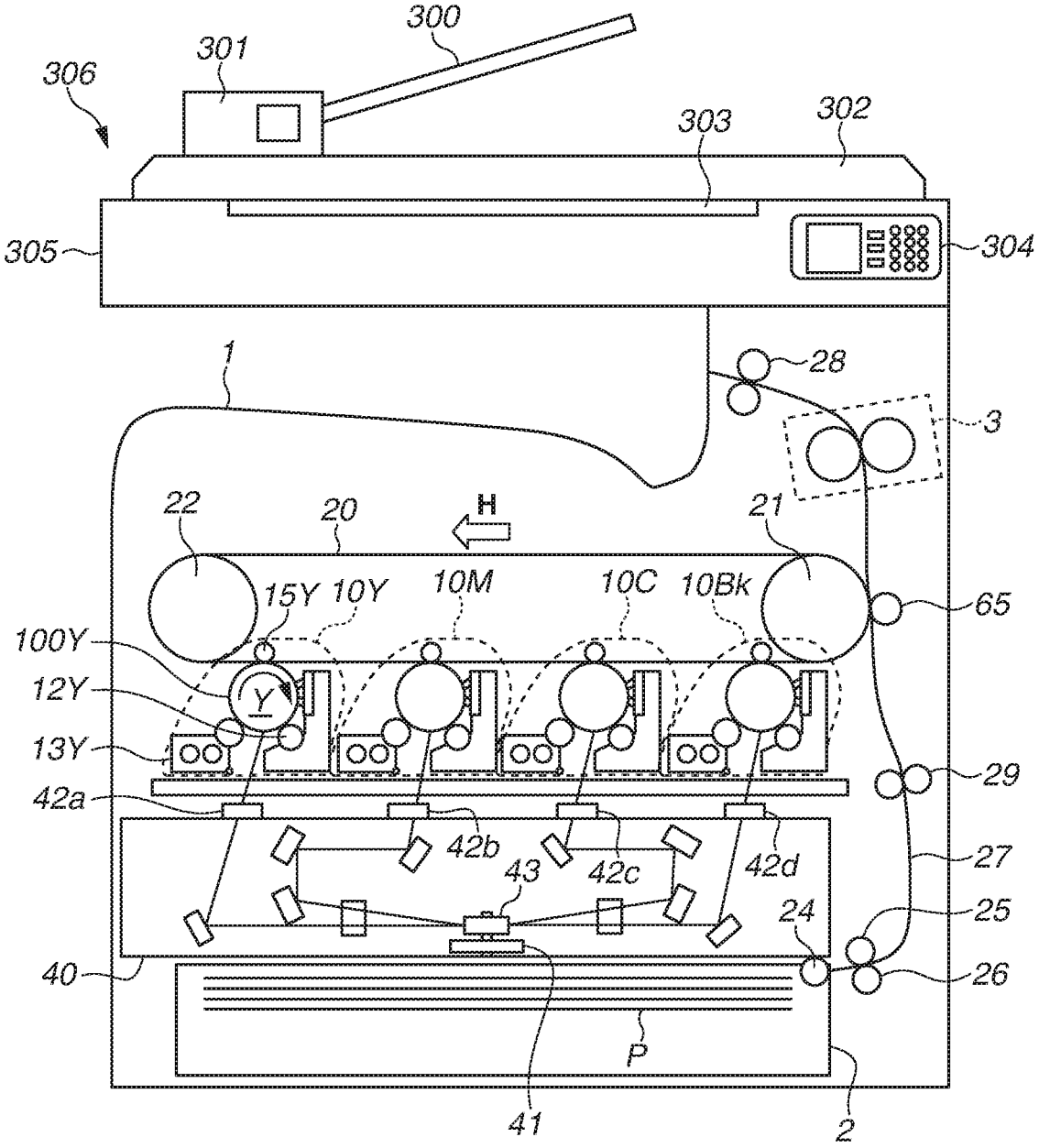
FIG. 1 is a schematic sectional view of an image forming apparatus.

FIG. 1 is a schematic sectional view illustrating the overall configuration of an image forming apparatus 1 according to a first exemplary embodiment. As illustrated in FIG. 1, the image forming apparatus 1 in the present exemplary embodiment is a color laser beam printer of the tandem type equipped with four image forming units 10Y, 10M, 10C, and 10Bk, which form toner images for respective colors of yellow (Y), magenta (M), cyan (C), and black (Bk).

Moreover, the image forming apparatus 1 in the present exemplary embodiment includes a reader unit 306 located in an upper portion of the main body thereof. The reader unit 306 includes a document conveyance device 301, which automatically conveys a document, a document reading device 305, which reads an image of the conveyed document, and a document discharge tray 302, to which the document is discharged.

The document conveyance device 301 includes a document feeding tray 300, onto which a document is set. The document conveyance device 301 conveys a document placed on the document feeding tray 300 on a sheet-by-sheet basis to a document reading position on a glass 303 of the document reading device 305. The document conveyed onto the glass 303 is read by a scanner (not illustrated), such as a charge-coupled device (CCD) sensor or a contact image sensor (CIS), provided inside the document reading device 305. After that, the document conveyance device 301 further conveys the document, and then discharges the document onto the document discharge tray 302.

The document conveyance device 301 is configured to be openable and closable with respect to the document reading device 305, so that the operator is allowed to open the document conveyance device 301 and then place a document on the glass 303.

Then, the scanner causes a light source to radiate light to a document conveyed onto the glass 303 by the document conveyance device 301 or a document placed on the glass 303, causes a light receiving sensor to receive reflected light from the document, and converts the received light into an electrical signal. The scanner outputs electrical signals for red (r), green (g), and blue (b) components obtained by such conversion to a control unit, such as engine control unit 74 (FIG. 6) described below.

Moreover, as illustrated in FIG. 1, the image forming apparatus 1 in the present exemplary embodiment includes an operation unit 304. The operation unit 304 includes a display, which displays setting information about a printing condition to an operator such as the user or service engineer.

The display is able to display software keys, which are operated by the operator touching the software keys with, for example, the finger. With this, the operator is able to input instruction information about, for example, one-sided printing or two-sided printing, via an operation panel of the display.

Figure 6:
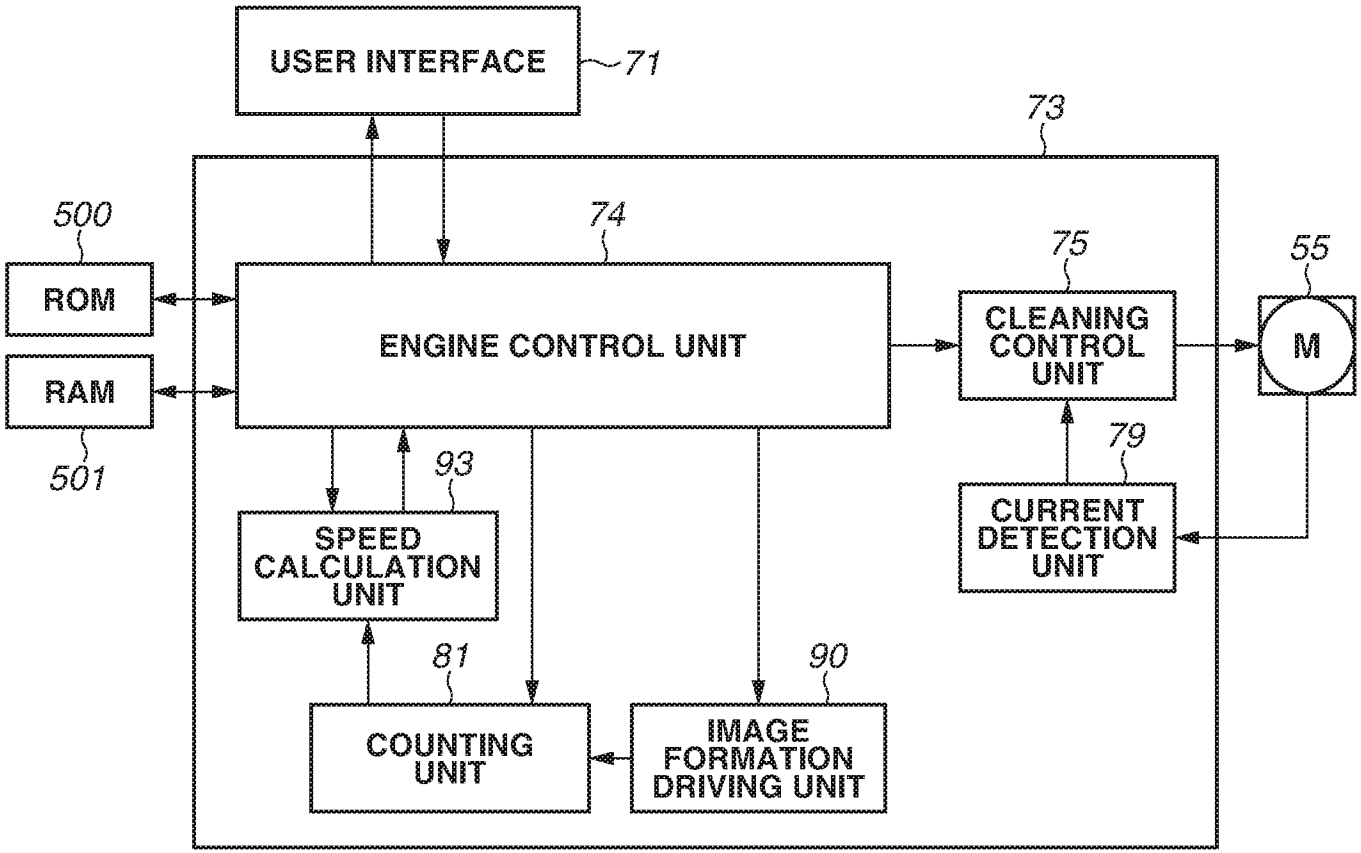
FIG. 6 is a control block diagram illustrating a configuration for performing a cleaning operation.

The operation unit 304 includes a start key, which is configured to be pressed to start an image forming operation, and a stop key, which is configured to be pressed to stop the image forming operation. A numeric keypad includes keys which are configured to be pressed to perform, for example, setting of the number of image-formed sheets. While, in the image forming apparatus in the present exemplary embodiment, a start key, a stop key, and a numeric keypad are provided as hardware keys on the operation unit 304, these keys can be displayed as software keys on the display. Various pieces of data input via the operation unit 304 are stored in a random access memory (RAM) 501 (FIG. 6) via the engine control unit 74 (FIG. 6).

The image forming apparatus 1 includes an intermediate transfer belt 20, to which toner images formed by the respective image forming units 10Y, 10M, 10C, and 10Bk are transferred. Then, the intermediate transfer belt 20 is configured to transfer the toner images superposed on the intermediate transfer belt 20 from the respective image forming units 10 to a sheet P, which is a recording medium, thus forming a color image on the sheet P (on a recording medium). Furthermore, the image forming units 10Y, 10M, 10C, and 10Bk have approximately the same configuration except for colors of toners used for the respective image forming units 10. In the subsequent description, the image forming unit 10Y is described an example of each image forming unit 10, and duplicate descriptions of the image forming units 10M, 10C, and 10Bk are omitted. Here, the recording medium as used in the present exemplary embodiment not only includes paper used for usual printing but also broadly includes, for example, cloth, plastic, and film.

Each image forming unit 10 includes a photosensitive member 100, a charging roller 12, which electrically charges the photosensitive member 100 to a uniform background potential, a developing device 13 including a developing sleeve, which develops an electrostatic latent image formed on the photosensitive member 100 by an optical scanning device 40 described below to form a toner image, and a primary transfer roller 15, which transfers the formed toner image to the intermediate transfer belt 20. Here, the primary transfer roller 15 forms a primary transfer portion between the photosensitive member 100 and the primary transfer roller 15 across the intermediate transfer belt 20, and receives a predetermined transfer voltage applied thereto to transfer the toner image formed on the photosensitive member 100 to the intermediate transfer belt 20.

The intermediate transfer belt 20 is formed in the shape of an endless belt, is suspended in a tensioned manner around a first belt conveyance roller 21 and a second belt conveyance roller 22, and is configured to rotationally operate in the direction of arrow H, so that toner images formed by the respective image forming units 10 are transferred to the intermediate transfer belt 20, which is rotating. Here, the four image forming units 10Y, 10M, 10C, and 10Bk are arranged side by side below the intermediate transfer belt 20 as viewed in the vertical direction, so that toner images formed on the respective photosensitive members 100 according to image information for the respective colors are transferred to the intermediate transfer belt 20. Image forming processes for the respective colors which are performed by the image forming units 10 are performed at timing when each toner image is superposed on a toner image at the upstream side primarily transferred onto the intermediate transfer belt 20. As a result, toner images for the respective four colors are formed in a superposed manner on the intermediate transfer belt 20.

Moreover, the first belt conveyance roller 21 and a secondary transfer roller 65 are brought into pressure contact with each other across the intermediate transfer belt 20, and the first belt conveyance roller 21 forms a secondary transfer portion, which is provided for transferring toner images onto a sheet P, between the secondary transfer roller 65 and the first belt conveyance roller 21 across the intermediate transfer belt 20. The sheet P is inserted into the secondary transfer portion, so that the toner images are transferred from the intermediate transfer belt 20 to the sheet P. Furthermore, transfer residual toner, which remains on the surface of the intermediate transfer belt 20, is recovered by a belt cleaning device (not illustrated).

Here, with regard to the image forming units 10 for the respective colors, the image forming unit 10Y, which forms a toner image for yellow, the image forming unit 10M, which forms a toner image for magenta, the image forming unit 10C, which forms a toner image for cyan, and the image forming unit 10Bk, which forms a toner image for black, are arranged in order from the upstream side with respect to the secondary transfer portion in the rotational direction of the intermediate transfer belt 20 (in the direction of arrow H).

Moreover, the optical scanning device 40 serving as an optical scanning unit, which performs scanning of laser light on the respective photosensitive members 100 and thus forms electrostatic latent images corresponding to image information on the respective photosensitive members 100, is located below the image forming units 10 as viewed in the vertical direction. Here, the image forming units 10 and the optical scanning device 40 are an example of an image forming unit.

The optical scanning device 40 includes four semiconductor lasers (not illustrated), which emit laser beams modulated according to pieces of image information for the respective colors. Moreover, the optical scanning device 40 includes a motor unit 41 and a rotary polygonal mirror 43, which is rotated at high speed by the motor unit 41 in such a way as to deflect the laser beams emitted from the respective semiconductor lasers in a scanning manner along the rotational axis direction of each photosensitive member 100. The respective laser beams deflected by the rotary polygonal mirror 43 are guided by optical members located inside the optical scanning device 40 and are then emitted from the inside of the optical scanning device 40 to the outside thereof via transparent members 42*a* to 42*d*, which respectively cover opening portions provided at an upper portion of the optical scanning device 40, so that the photosensitive members 100 are exposed to the respective laser beams emitted from the optical scanning device 40.

On the other hand, sheets P are stored in a sheet feeding cassette 2, which is located at a lower portion of the image forming apparatus 1. Then, a sheet P is fed by a pickup roller 24 to a separation nip portion formed by a sheet feeding roller 25 and a retard roller 26. Here, transmission of drive is configured in such a manner that the retard roller 26 rotates backward when a plurality of sheets P has been concurrently fed by the pickup roller 24, so that sheets P are conveyed on a sheet-by-sheet basis to the downstream side, thus preventing double feeding of sheets P. The sheet P conveyed by the sheet feeding roller 25 and the retard roller 26 on a sheet-by-sheet basis is conveyed to a conveyance path 27, which extends approximately in a vertical fashion along the right lateral side of the image forming apparatus 1.

Then, the sheet P is conveyed from the lower side in the vertical direction of the image forming apparatus 1 to the upper side in the vertical direction of the image forming apparatus 1 through the conveyance path 27, and is then conveyed to a registration roller 29. The registration roller 29 temporarily stops the sheet P, which has been conveyed, and corrects skewing of the sheet P. After that, the registration roller 29 conveys the sheet P to the secondary transfer portion in conformity with timing at which the toner images formed on the intermediate transfer belt 20 are conveyed to the secondary transfer portion. After that, the sheet P to which the toner images have been transferred at the secondary transfer portion is conveyed to a fixing device 3, so that the toner images are pressed and heated by the fixing device 3 and are thus fixed to the sheet P. Then, the sheet P having the toner images fixed thereto is discharged by a discharge roller 28 to a discharge tray located outside the image forming apparatus 1 and in an upper portion of the main body of the image forming apparatus 1.

In this way, since the image forming apparatus 1 has a configuration in which the image forming units 10 are located above the optical scanning device 40, in some cases, a foreign substance, such as toner, paper dust, or mote, may fall onto the transparent members 42*a* to 42*d*, which are provided in an upper portion of the optical scanning device 40. In these cases, laser beams which are radiated toward the photosensitive members 100 via the transparent members 42*a* to 42*d* may be blocked by the foreign substance. Accordingly, a change in optical property may occur in the optical scanning device 40, so that the quality of an image to be formed may decrease in some cases.

Figure 2:
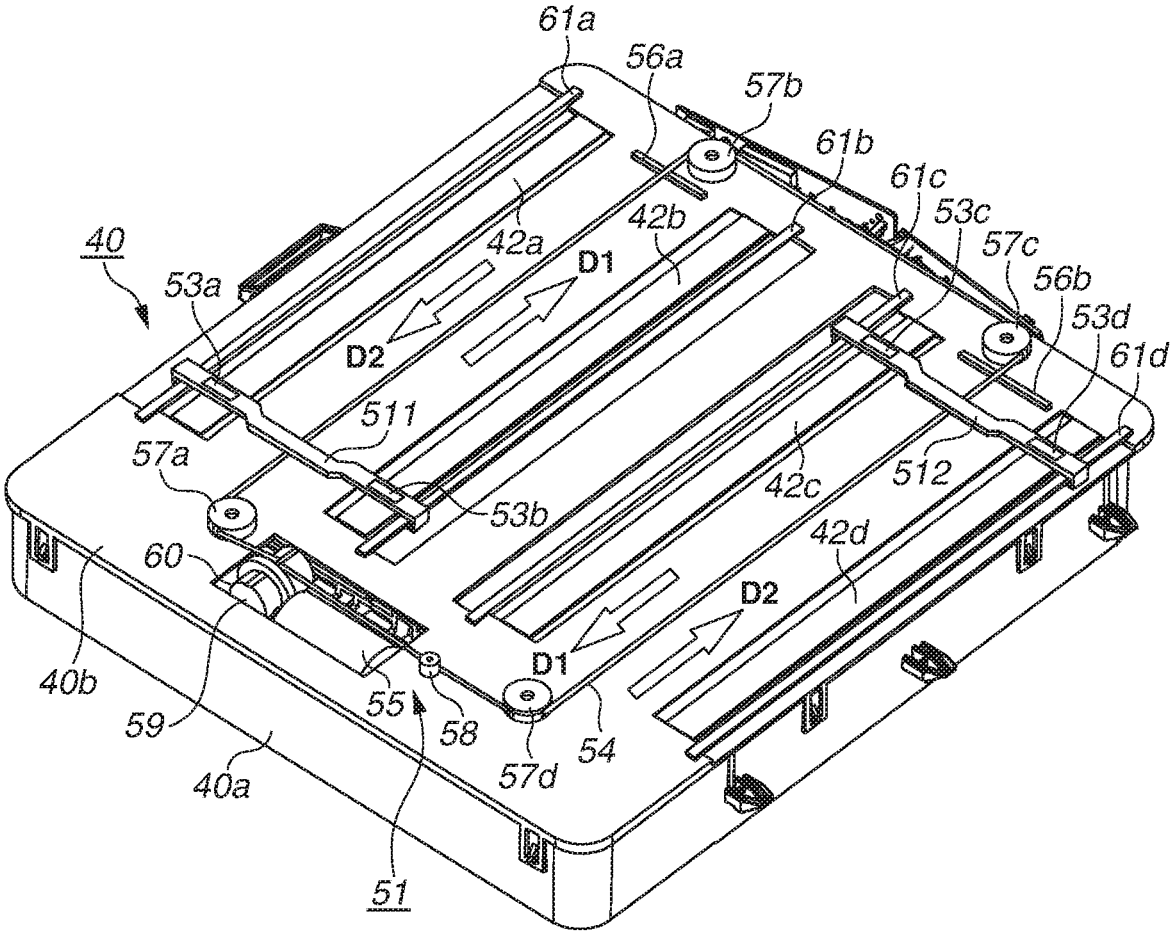
FIG. 2 is a perspective view of an optical scanning device.

Therefore, in the present exemplary embodiment, the image forming apparatus 1 includes a cleaning mechanism 51, which is configured to clean the transparent members 42*a* to 42*d* of the optical scanning device 40. In the following description, the optical scanning device 40 and the cleaning mechanism 51, which is provided for the optical scanning device 40, are described in detail. FIG. 2 is a perspective view illustrating the entire optical scanning device 40, and FIG. 3 is a top view of the optical scanning device 40.

Figure 3:
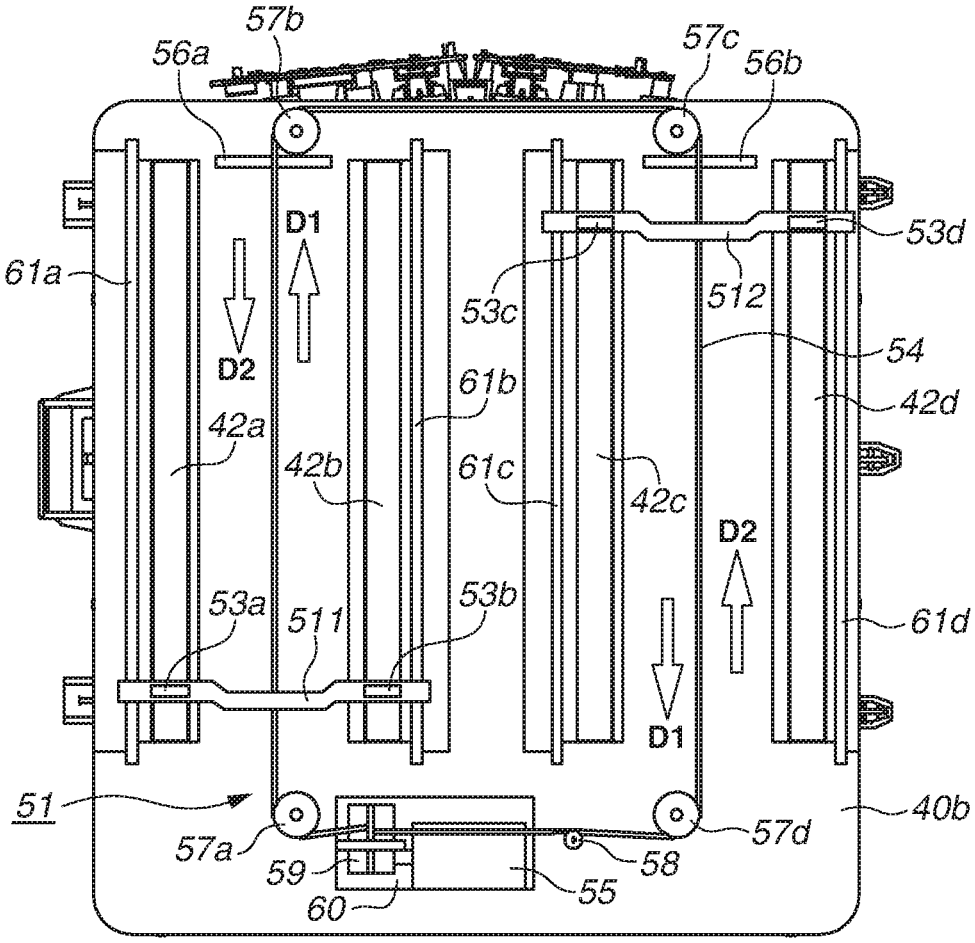
FIG. 3 is a top view of the optical scanning device.

As illustrated in FIG. 2 and FIG. 3, the optical scanning device 40 includes a container portion 40*a*, which contains therein the above-mentioned motor unit 41 (FIG. 1) and the rotary polygonal mirror 43 (FIG. 1), and a cover portion 40*b*, which is attached to the container portion 40*a* and covers the top side of the container portion 40*a*. Here, the casing of the optical scanning device 40 is configured with the container portion 40*a* and the cover portion 40*b*. The cover portion 40*b* is provided with four opening portions, through which laser beams pass with respect to the photosensitive members 100 for the respective colors, and each opening portion is of a rectangular shape elongated in the rotational axis direction of the associated photosensitive member 100 and the respective opening portions are formed in such a way as to extend in the longitudinal direction thereof in parallel with each other. Then, the respective opening portions are occluded by the transparent members 42*a* to 42*d*, each of which is formed in an elongated rectangular shape. The transparent members 42*a* to 42*d*, the number of which is four as with the opening portions, are attached to the cover portion 40*b* in such a way as to extend in the longitudinal direction thereof in parallel with each other. Furthermore, the longitudinal direction of each of the transparent members 42*a* to 42*d* is approximately equal to the scanning direction of laser light which is emitted from the optical scanning device 40. Moreover, in the present exemplary embodiment, the longitudinal direction of each of the transparent members 42*a* to 42*d* is approximately equal to the rotational axis direction of the associated one of the photosensitive members 100.

Here, the transparent members 42*a* to 42*d* are provided to prevent a foreign substance, such as toner, mote, or paper dust, from intruding into the optical scanning device 40, thus preventing a decrease in image quality from occurring due to a foreign substance adhering to, for example, the semiconductor laser, the mirrors, or the rotary polygonal mirror 43. Each of the transparent members 42*a* to 42*d* is formed from a transparent material such as glass, and is configured to allow laser light emitted from the semiconductor laser contained in the container portion 40*a* to be radiated toward the photosensitive member 100. In the present exemplary embodiment, the size of each of the transparent members 42*a* to 42*d* is set larger than the opening of each opening portion, and the transparent members 42*a* to 42*d* are configured to cover the respective opening portions in an overlapping manner. Then, the transparent members 42*a* to 42*d* are fixed to the cover portion 40*b* by bonding the overlapped portions of the transparent members 42*a* to 42*d* to the respective opening portions.

In this way, the optical scanning device 40 is configured to be covered by the cover portion 40*b* and the transparent members 42*a* to 42*d* in such a manner that a foreign substance, such as toner, paper dust, or mote, does not intrude into the optical scanning device 40. Moreover, since the transparent members 42*a* to 42*d*, each of which is larger than each opening portion, are bonded and fixed onto the cover portion 40*b*, a foreign substance, such as toner, paper dust, or mote, which may fall from above the optical scanning device 40, is prevented from intruding into the optical scanning device 40 through clearance gaps between the transparent members 42*a* to 42*d* and the respective opening portions.

Then, in the present exemplary embodiment, the image forming apparatus 1 includes the cleaning mechanism 51, which cleans off a foreign substance having fallen from above to the top surface of the optical scanning device 40 (the top surfaces of the transparent members 42*a* to 42*d*). Here, the top surfaces of the transparent members 42*a* to 42*d* are outside surfaces with respect to the optical scanning device 40 and are surfaces from which laser beams passing through the transparent members 42*a* to 42*d* exit.

The cleaning mechanism 51 is attached onto the cover portion 40*b* of the optical scanning device 40 at the side facing the image forming units 10. The cleaning mechanism 51 includes cleaning members 53*a* to 53*d*, which are configured to respectively clean the top surfaces of the transparent members 42*a* to 42*d* (the outer side surface of the optical scanning device 40), and a first cleaning holder 511 and a second cleaning holder 512, which hold the cleaning members 53*a* to 53*d* and move the cleaning members 53*a* to 53*d* on the transparent members 42*a* to 42*d*.

Each of the first cleaning holder 511 and the second cleaning holder 512 extends between two adjacent transparent members 42 in a direction perpendicular to the direction in which each transparent member 42 extends, and includes two cleaning members 53. Here, the number of cleaning members 53 included in the first cleaning holder 511 and the second cleaning holder 512 corresponds to the number of transparent members 42.

More specifically, the first cleaning holder 511 is located in such a way as to extend between the transparent members 42*a* and 42*b*, and includes the cleaning member 53*a*, which cleans the top surface of the transparent member 42*a*, and the cleaning member 53*b*, which cleans the top surface of the transparent member 42*b*. Moreover, the second cleaning holder 512 is located in such a way as to extend between the transparent members 42*c* and 42*d*, and includes the cleaning member 53*c*, which cleans the top surface of the transparent member 42*c*, and the cleaning member 53*d*, which cleans the top surface of the transparent member 42*d*.

Each of the cleaning members 53*a* to 53*d* is made from, for example, silicon rubber or unwoven cloth. The cleaning members 53*a* to 53*d* move while being in contact with the top surfaces of the transparent members 42 in conjunction with the movement of the first cleaning holder 511 and the second cleaning holder 512, so that the cleaning members 53*a* to 53*d* are able to remove foreign substances on the transparent members 42 and are thus able to clean the surface of the transparent members 42.

The first cleaning holder 511 has a central portion coupled to a wire 54, and is configured to hold the cleaning members 53*a* and 53*b* at both ends of the first cleaning holder 511 across the wire 54. Moreover, the second cleaning holder 512 has a central portion coupled to the wire 54, and is configured to hold the cleaning members 53*c* and 53*d* at both ends of the second cleaning holder 512 across the wire 54. Accordingly, the wire 54 is stretched in a tensioned state in such a way as to pass between the transparent members 42*a* and 42*b* and between the transparent members 42*c* and 42*d*.

Moreover, the wire 54 is stretched in a tensioned state in a circular manner on the cover portion 40*b* with use of four tensile stretching pulleys 57*a* to 57*d*, which are rotatably held on the cover portion 40*b*, a tension adjusting pulley 58, and a take-up drum 59. Then, the wire 54 is stretched in a tensioned state around the tensile stretching pulleys 57*a* to 57*d* in the state in which the length of the wire 54 was adjusted by the wire 54 being taken up a predetermined number of turns around the take-up drum 59 during assembly of the apparatus. At this time, as mentioned above, the four tensile stretching pulleys 57*a* to 57*d* are arranged in such a manner that the wire 54 passes between the transparent members 42*a* and 42*b* and between the transparent members 42*c* and 42*d*.

The tension of the wire 54 is adjusted by the tension adjusting pulley 58, which is located between the tensile stretching pulleys 57*a* and 57*d*. Therefore, the wire 54 is placed in a tensioned state without slack between the tensile stretching pulleys 57, the tension adjusting pulley 58, and the take-up drum 59. With this, since the wire 54 is stretched in a tensioned state, it is possible to cause the wire 54 to smoothly run in a circular way.

While, in the present exemplary embodiment, a configuration in which the tension adjusting pulley 58 is located between the tensile stretching pulleys 57*a* and 57*d* is employed, the location of the tension adjusting pulley 58 does not need to be limited to such a position as long as the position is available to adjust the tension of the wire 54 suspended in a tensioned manner around the tensile stretching pulleys 57*a* to 57*d*.

In this way, in the present exemplary embodiment, a configuration in which the first cleaning holder 511 is provided with the cleaning members 53*a* and 53*b* and the second cleaning holder 512 is provided with the cleaning members 53*c* and 53*d* is employed. On the other hand, in a case where one cleaning holder is provided with one cleaning member, a number of cleaning holders corresponding to the number of transparent members are to be provided, so that the length of the wire stretched in a tensioned state to move the cleaning holders becomes large. Accordingly, in the present exemplary embodiment, as compared with a configuration in which one cleaning member is held by one cleaning holder, it is possible to reduce the number of cleaning holders and it is possible to make the length of the wire 54 shorter, so that it is possible to clean the top surfaces of the transparent members 42*a* to 42*d* with a simpler configuration.

Moreover, the take-up drum 59 is configured to be able to be rotated by driving of a take-up motor 55 serving as a drive unit.

Here, the take-up motor 55 is configured to be able to rotate forward and backward. In the present exemplary embodiment, the forward rotation of the take-up motor 55 is set as the clockwise (CW) direction, and the backward rotation thereof is set as the counterclockwise (CCW) direction.

Accordingly, the wire 54 is configured to be taken up onto and paid out from the take-up drum 59 by the take-up drum 59 being rotated by the rotation of the take-up motor 55 in the CW direction or CCW direction. In this way, when being taken up and paid out by the take-up drum 59, the wire 54 is able to run in a circular manner on the cover portion 40*b* while being suspended in a tensioned manner by the tensile stretching pulleys 57.

Therefore, the first cleaning holder 511 and the second cleaning holder 512, which are coupled to the wire 54, are able to move in the directions of arrows D1 and D2 (along the longitudinal direction of each transparent member 42) in association with running of the wire 54. In the present exemplary embodiment, as the take-up motor 55 rotates in the CCW direction, the first cleaning holder 511 and the second cleaning holder 512 move in the direction of arrow D1. Moreover, as the take-up motor 55 rotates in the CW direction, the first cleaning holder 511 and the second cleaning holder 512 move in the direction of arrow D2.

At this time, since the wire 54 is stretched in a tensioned state in a circular manner, the first cleaning holder 511 and the second cleaning holder 512 are configured to move in the respective opposite directions in a linear manner along the longitudinal direction of each of the transparent members 42*a* to 42*d* in association with movement of the wire 54.

Here, the take-up motor 55 and the take-up drum 59 are located in a recessed portion 60, which is provided in such a way as to be recessed with respect to the top surface of the cover portion 40*b*. This enables reducing the size of the optical scanning device 40 in the height direction thereof. Furthermore, the recessed portion 60 does not communicate with the inside of the optical scanning device 40, so that a foreign substance also does not intrude into the optical scanning device 40 from the recessed portion 60.

Moreover, the cover portion 40*b* is provided with a first stopper 56*a*, which limits the movement of the first cleaning holder 511 in the longitudinal direction of each of the transparent members 42*a* and 42*b* (the rotational axis direction of each photosensitive member 100). Moreover, the cover portion 40*b* is also provided with a second stopper 56*b*, which limits the movement of the second cleaning holder 512 in the longitudinal direction of each of the transparent members 42*c* and 42*d* (the rotational axis direction of each photosensitive member 100). Here, each of the first stopper 56*a* and the second stopper 56*b* is an example of a contact member.

The first stopper 56*a* and the second stopper 56*b* are located at one end side in the longitudinal direction of each of the transparent members 42*a* to 42*d*. Accordingly, when the first cleaning holder 511 and the second cleaning holder 512 are moving in the direction of arrow D1, the first cleaning holder 511 arrives at the end portions of the transparent members 42*a* and 42*b* in the direction of arrow D1, thus coming into contact with the first stopper 56*a*.

With this, since the movement of the first cleaning holder 511 in the direction of arrow D1 is limited by the first stopper 56*a*, a load acting on the take-up motor 55, which rotates the take-up drum 59 to cause the wire 54 to run, becomes large. Such a load is detected with use of a current detection unit described below, so that the first cleaning holder 511 having arrived at the first stopper 56*a* is detected. At this time, the second cleaning holder 512 is situated at the side opposite to the side at which the first cleaning holder 511 is situated in the longitudinal direction of each of the transparent members 42.

Furthermore, a series of cleaning operations performed with the movement of the first cleaning holder 511 and the second cleaning holder 512 in the present exemplary embodiment is as follows.

First, when the take-up motor 55 is driven to rotate in the CW direction, the wire 54 runs in the direction of arrow D2, so that the first cleaning holder 511 and the second cleaning holder 512 move in the direction of arrow D2.

After that, the second cleaning holder 512 arrives at the end portions of the transparent members 42*c* and 42*d* in the direction of arrow D2, thus coming into contact with the second stopper 56*b*. With this, since the movement of the second cleaning holder 512 in the direction of arrow D2 is limited by the second stopper 56*b*, a load acting on the take-up motor 55, which rotates the take-up drum 59 to cause the wire 54 to run, becomes large. Such a load is detected with use of a current detection unit described below, so that the second cleaning holder 512 having arrived at the second stopper 56*b* is detected.

Then, when the second cleaning holder 512 having arrived at the second stopper 56*b* has been detected, the take-up motor 55 is stopped from rotating. At this time, the first cleaning holder 511 arrives at the other end side, i.e., at a second position, in the longitudinal direction of each of the transparent members 42. Accordingly, when the take-up motor 55 is stopped from rotating, the first cleaning holder 511 is stopped from moving at the second position in the longitudinal direction of each of the transparent members 42.

After that, the take-up motor 55 is rotated in the CCW direction, thus causing the wire 54 to run in the direction of arrow D1. With this, each of the first cleaning holder 511 and the second cleaning holder 512 moves in the direction of arrow D1.

After that, the first cleaning holder 511 arrives at the end portions of the transparent members 42*a* and 42*b* in the direction of arrow D1, thus coming into contact with the first stopper 56*a*. With this, since the movement of the first cleaning holder 511 in the direction of arrow D1 is limited by the first stopper 56*a*, a load acting on the take-up motor 55, which rotates the take-up drum 59 to cause the wire 54 to run, becomes large. Such a load is detected with use of a current detection unit described below, so that the first cleaning holder 511 having arrived at the first stopper 56*a* is detected.

Then, when the first cleaning holder 511 having arrived at the first stopper 56*a* has been detected, the take-up motor 55 is stopped from rotating in the CCW direction and is then rotated a predetermined number of rotations in the CW direction. With this, after the wire 54 is caused to run a predetermined distance in the direction of arrow D2, the take-up motor 55 is stopped from rotating.

In this way, in the present exemplary embodiment, each of the first cleaning holder 511 and the second cleaning holder 512 performing one reciprocating movement on the transparent members 42*a* to 42*d* is defined as a series of cleaning operations. Then, after the series of cleaning operations is ended, the wire 54 is caused to run a predetermined distance in the direction of arrow D2 and is then stopped, so that the operation of the first cleaning holder 511 is stopped at a position where the first cleaning holder 511 is not kept in contact with the first stopper 56*a* and the cleaning members 53 are not in contact with the surfaces of the transparent members 42.

In other words, the first cleaning holder 511 is stopped at a position in a non-passage region which is between the end portions of the transparent members 42 in the longitudinal direction of each of the transparent members 42 and the first stopper 56*a* and in which laser light does not pass through the transparent members 42. Furthermore, at this time, the second cleaning holder 512 is stopped at a position where the second cleaning holder 512 is not kept in contact with the end portions of the transparent members 42 in the longitudinal direction thereof, i.e., in a non-passage region in which laser light does not pass through the transparent members 42. Here, the stopping positions of the first cleaning holder 511 and the second cleaning holder 512 taken when a series of cleaning operations is ended are cleaning stopping positions and are thus cleaning start positions.

While, in the series of cleaning operations described above, a configuration in which, when the second cleaning holder 512 has arrived at the second stopper 56*b*, the take-up motor 55 is stopped from rotating and is then rotated in the CCW direction is employed, a configuration in which, in response to the second cleaning holder 512 arriving at the second stopper 56*b*, the take-up motor 55 is rotated in the CCW direction can be employed.

Furthermore, while, in the present exemplary embodiment, a configuration in which the take-up motor 55 is rotated forward (rotated in the CW direction) to cause the wire 54 to run in the direction of arrow D2 and the take-up motor 55 is rotated backward (rotated in the CCW direction) to cause the wire 54 to run in the direction of arrow D1 is employed, a configuration in which the take-up motor 55 is rotated forward to cause the wire 54 to run in the direction of arrow D1 and the take-up motor 55 is rotated backward to cause the wire 54 to run in the direction of arrow D2 can be employed.

Moreover, the cover portion 40*b* is provided with guide members 61*a* to 61*d*, which are configured to guide the movement of the first cleaning holder 511 and the second cleaning holder 512. Then, as illustrated in FIG. 4 and FIG. 5, both end portions of the first cleaning holder 511 respectively engage with the guide members 61*a* and 61*b*.

Figure 4:
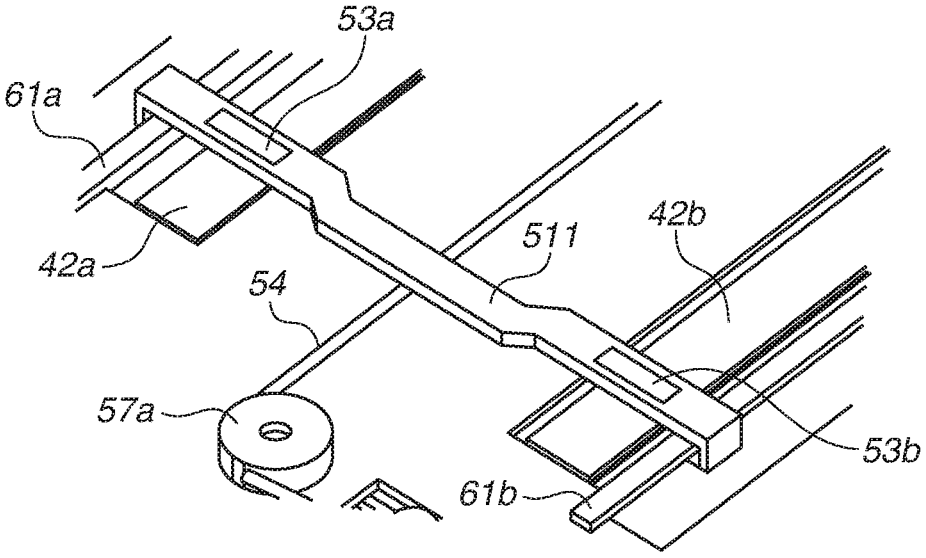
FIG. 4 is a partial perspective view of a first cleaning holder.

Here, FIG. 4 is a partial perspective view illustrating the vicinity of the first cleaning holder 511. Furthermore, with regard to the second cleaning holder 512, as with the first cleaning holder 511, both end portions of the second cleaning holder 512 respectively engage with the guide members 61*c* and 61*d*. FIG. 5 is a partial sectional view illustrating an end portion at the side where the cleaning member 53*a* of the first cleaning holder 511 is held. While, here, only the configuration of the first cleaning holder 511 is described, in the present exemplary embodiment, the same configuration is assumed to be also used for the second cleaning holder 512.

Figure 5:
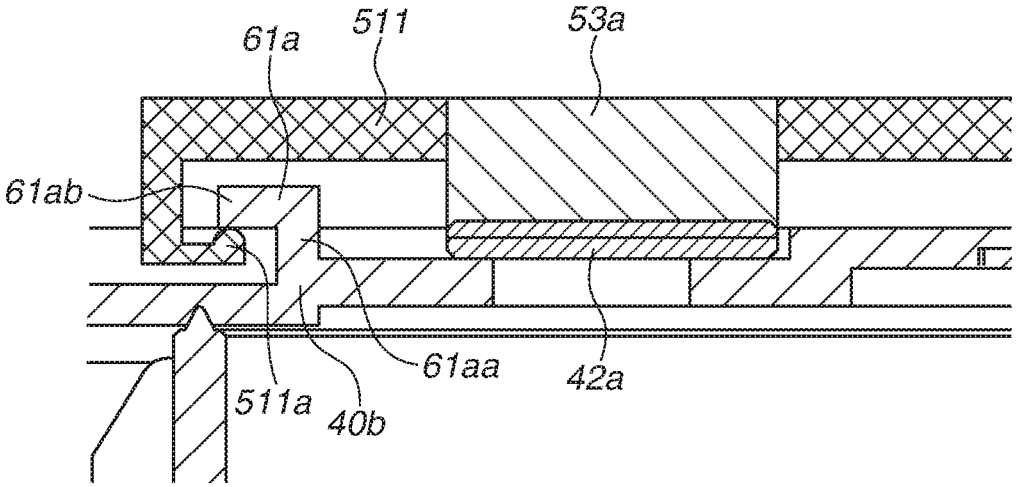
FIG. 5 is a partial sectional view of the first cleaning holder.

As illustrated in FIG. 4 and FIG. 5, the guide members 61*a* and 61*b* are formed integrally with the cover portion 40*b* and are provided to project from the top surface of the cover portion 40*b* upward.

Here, each of the guide members 61*a* to 61*d* includes, as illustrated in FIG. 5, a first projecting portion 61*aa*, which projects from the top surface of the cover portion 40*b* upward, and a second projecting portion 61*ab*, which extends from the first projecting portion 61*aa* in a direction away from the cleaning member 53*a*.

Then, an end portion 511*a* at one side of the first cleaning holder 511 is formed in such a way as to get into under the second projecting portion 61*ab*. Here, the end portion 511*a* is configured to have a circular arc-like portion with which the second projecting portion 61*ab* is in contact. In this way, since the end portion 511*a* has a circular arc-like portion, it is possible to reduce a sliding resistance occurring when the first cleaning holder 511 moves in the direction of arrow D1 or the direction of arrow D2 (see FIG. 3).

Furthermore, while, in the present exemplary embodiment, only one end side of the first cleaning holder 511 is described in detail, the other end side thereof, i.e., the guide member 61*b*, is assumed to also have a similar configuration. Moreover, the second cleaning holder 512 is assumed to also have a similar shape.

Moreover, since the first cleaning holder 511 and the second cleaning holder 512 engage with the guide members 61*a* to 61*d*, it is possible to prevent or reduce the cleaning members 53*a* to 53*d*, which are held by the first cleaning holder 511 and the second cleaning holder 512, from moving in a direction away from the transparent members 42*a* to 42*d*. At this time, positions of engagement between the first cleaning holder 511 and the second cleaning holder 512 and the guide members 61*a* to 61*d* are set as positions where the cleaning members 53*a* to 53*d* are in contact with the transparent members 42*a* to 42*d* at a predetermined contact pressure.

Moreover, in the present exemplary embodiment, the guide members 61*a* to 61*d*, the first stopper 56*a*, and the second stopper 56*b* are configured to be formed from resin integrally with the cover portion 40*b*, but can be configured to be formed separately from the cover portion 40*b*.

As described above, in the present exemplary embodiment, moving the first cleaning holder 511 and the second cleaning holder 512 in the directions of arrow D1 and arrow D2, respectively, during a cleaning operation enables cleaning the top surfaces of the transparent members 42*a* to 42*d*. Then, the cleaning operation is performed when an instruction for performing the cleaning operation has been received from the operator via, for example, the operation unit 304 at optional timing, or is periodically performed in response to the integrated number of image-formed sheets reaching a predetermined number of sheets.

Here, the predetermined number of sheets, based on which the cleaning operation is periodically performed, is previously set to, for example, 10,000 sheets as initial setting. With respect to such initial setting, the operator is able to set or change the predetermined number of sheets, based on which the cleaning operation is periodically performed, by, for example, inputting a value in units of 500 sheets via the operation unit 304.

As mentioned above, in the case of determining timing of a cleaning operation according to the number of image-formed sheets, depending on contents of an image forming job, it may be impossible to perform the cleaning operation at appropriate timing. For example, in the case of performing image formation on a recording medium larger in grammage than plain paper, such as heavy paper or overhead transparency (OHT) sheet or in the case of performing image formation in high image quality mode, the image forming speed (process speed) is changed. At this time, in a case where the image forming speed is high, since the rotational speed of the developing speed or the photosensitive member 100 is higher than in a case where the image forming speed is low, toner is likely to scatter due to, for example, centrifugal force.

However, in a case where the number of image-formed sheets based on which a cleaning operation is performed is set in conformity with a case where the image forming speed is low, when an image forming job in which the image forming speed is high is performed, although toner is scattering, a cleaning operation may not be performed. As a result, light emitted from the optical scanning device 40 may be blocked by toner having scattered on the transparent members, so that the quality of an image to be formed may decrease in some cases.

Moreover, in a case where the number of image-formed sheets based on which a cleaning operation is performed is set in conformity with a case where the image forming speed is high, when an image forming job in which the image forming speed is low is performed, although toner is not scattering, a cleaning operation may be performed at early timing. In other words, since, despite a state in which a cleaning operation is not required, the cleaning operation may be unnecessarily performed, usability is poor.

Therefore, the present exemplary embodiment is configured to determine timing at which to perform a cleaning operation based on contents of an image forming job, such as the type of a recording medium or the image quality.

In the subsequent description, a sequence which is performed during execution of an image forming job is described with reference to FIG. 6 to FIG. 9. FIG. 6 is a control block diagram illustrating a control configuration for performing a cleaning operation during execution of an image forming job in the present exemplary embodiment.

As illustrated in FIG. 6, an integrated circuit (IC) controller 73 includes, as built-in modules, an engine control unit 74, a cleaning control unit 75, which controls the take-up motor 55, a current detection unit 79, which detects a driving current for the take-up motor 55, an image formation driving unit 90, which drives, for example, the image forming units 10 and the intermediate transfer belt 20 to perform image formation, a count unit 81, which serves as a counter to count the number of times of image formation, and a speed calculation unit 93, which calculates an output value of the count unit 81 according to the image forming speed of the image forming apparatus 1.

The IC controller 73 is configured to control a user interface 71, the take-up motor 55, and the image forming units 10 via the various modules. In the subsequent description, control of a cleaning operation which the IC controller 73 performs via the various modules is described.

The IC controller 73 reads out a firmware program and a boot program for controlling the firmware program stored in a read-only memory (ROM) 500 via the engine control unit 74, and performs various control operations with a random access memory (RAM) 501 used a work area and a temporary storage area for data. Here, the IC controller 73 is an example of a control unit.

Moreover, the IC controller 73 is able to acquire, for example, setting information about an image forming job from the operator via the user interface 71, which is displayed on the operation unit 304 provided on the image forming apparatus 1, and inform the operator of various pieces of information. Here, the operation unit 304 is an example of an operation unit, and is configured with, for example, a liquid-crystal type display panel and a resistance film type or capacitance type touch panel superposed on each other. Then, the user interface 71 is configured to allow the user to perform an operation via the touch panel based on displaying on the display panel. Timing for execution of cleaning is determined by, for example, a cleaning setting value stored in the RAM 501 via the user interface 71 by the operator (alternatively, an initial value of the cleaning setting value previously stored in the RAM 501).

Here, the IC controller 73 outputs an image formation signal, which indicates the number of times of image formation performed by the image forming units 10, via the engine control unit 74, and the count unit 81 performs counting of the image formation signal. Moreover, the speed calculation unit 93 sets a result obtained by multiplying a count value output from the count unit 81 by a speed coefficient as a count calculated value, and outputs the count calculated value to the engine control unit 74.

The engine control unit 74 compares the count calculated value and the cleaning setting value stored in the RAM 501 with each other, and outputs a cleaning execution instruction to the cleaning control unit 75 if the count calculated value is greater than or equal to the cleaning setting value stored in the RAM 501.

Then, the IC controller 73 outputs a motor control signal to the take-up motor 55 via the cleaning control unit 75, thus rotationally driving the take-up motor 55. On the other hand, during a cleaning operation, the IC controller 73 detects a motor driving current from the take-up motor 55 via the current detection unit 79.

Here, the take-up motor 55 is driven at a fixed voltage, and, when the first cleaning holder 511 or the second cleaning holder 512 comes into contact with the first stopper 56*a* or the second stopper 56*b*, the motor driving current increases in response to a load acting on the take-up motor 55 becoming large.

Accordingly, when the motor driving current detected by the current detection unit 79 has become larger than a predetermined value, the IC controller 73 detects that the first cleaning holder 511 or the second cleaning holder 512 has come into contact with the first stopper 56*a* or the second stopper 56*b* and the movement in one way from end portions of the transparent members 42*a* to 42*d* to the other end portions thereof has been ended. In other words, the IC controller 73 detects that cleaning in one way in the reciprocating movement has been ended. Accordingly, in response to detecting that the motor driving current has become larger than the predetermined value, the IC controller 73 causes the current detection unit 79 to transmit a movement completion notification signal to the cleaning control unit 75.

The predetermined value as mentioned herein is a value larger than the driving current value flowing through the take-up motor 55 during a period in which the first cleaning holder 511 or the second cleaning holder 512 is moving on the transparent members 42. In other words, the predetermined value is a value larger than the driving current value which is flowing through the take-up motor 55 before the first cleaning holder 511 or the second cleaning holder 512 comes into contact with the first stopper 56*a* or the second stopper 56*b*. Moreover, the predetermined value is set to a value which is available to detect that the first cleaning holder 511 or the second cleaning holder 512 has come into contact with the first stopper 56*a* or the second stopper 56*b* and which does not include the value of a current that increases due to a variation such as a malfunction of the take-up motor 55. Furthermore, the determination of ending of the movement of the first cleaning holder 511 and the second cleaning holder 512 from one end to the other end of each of the transparent members 42*a* to 42*d* in the longitudinal direction thereof can be performed not by making a comparison with the predetermined value but by determining the amount of change of the driving current value flowing through the take-up motor 55.

When it is determined that the cleaning operation has been completed, the IC controller 73 causes the engine control unit 74 and the cleaning control unit 75 to stop the take-up motor 55, and transmits a signal for cleaning completion notification to the user interface 71. In response to this signal, the user interface 71 makes a display indicating that the cleaning operation has been completed on a display portion (not illustrated), thus informing the operator that the cleaning operation has been completed.

On the other hand, if it is determined that the cleaning operation has not yet been completed, the IC controller 73 causes the engine control unit 74 to transmit the cleaning execution instruction signal to the cleaning control unit 75 again, and causes the cleaning control unit 75 to control the take-up motor 55, thus repeating the cleaning operation. Furthermore, the cleaning control unit 75 is able to perform control to cause the first cleaning holder 511 and the second cleaning holder 512 to perform a reciprocating movement by causing the take-up motor 55 to rotate forward and backward.

While, in the present exemplary embodiment, a configuration in which the engine control unit 74, the cleaning control unit 75, the current detection unit 79, the count unit 81, and the speed calculation unit 93 are incorporated in the IC controller 73 is employed, this configuration does not necessarily need to be employed. For example, a configuration in which modules different from the modules incorporated in the IC controller 73 described in the present exemplary embodiment are used to implement control for a cleaning operation by the IC controller 73 can also be employed, or a configuration in which a controller in which the ROM 500 and the RAM 501 are incorporated performs various control operations can also be employed.

Here, the image formation signal, which is output from the image formation driving unit 90 to the count unit 81, is output once when image formation has been performed on one side of a sheet, and is output twice in total when image formation has been performed on both sides of a sheet. Whenever receiving the image formation signal, the count unit 81 increases a count value by one.

Then, the speed calculation unit 93 multiplies the count value counted by the count unit 81 by a speed coefficient, thus calculating a count calculated value. Here, the speed coefficient is a coefficient which is changed according to an image forming speed.

Table 1 shows values of speed coefficients which are employed when the image forming apparatus 1 switches the image forming speed depending on paper setting included in an image forming job. Such speed coefficients are previously stored in, for example, the RAM 501.

TABLE 1

| Recording medium | Image forming speed [mm/s] | Speed coefficient |
|---|---|---|
| Plain paper | 200 | 1.00 |
| Heavy paper | 150 | 0.75 |
| OHT sheet | 100 | 0.50 |

In the present exemplary embodiment, "plain paper" is paper with a grammage of greater than or equal to 60 g/m$^2$ and less than 106 g/m$^2$, and "heavy paper" is paper with a grammage of greater than or equal to 106 g/m$^2$ and less than 221 g/m$^2$.

In the present exemplary embodiment, since heavy paper and OHT sheet, which are larger in grammage than plain paper, a larger amount of heat is used for fixing than plain paper, the image forming speed for heavy paper and OHT sheet is set lower. At this time, to vary the image forming speed, the rotational speed of the photosensitive member 100 or developing sleeve is changed. In other words, the rotational speed of the photosensitive member 100 or developing sleeve is lower in a case where image formation is performed on heavy paper or OHT sheet than in a case where image formation is performed on plain paper.

In the present exemplary embodiment, the image forming speed employed in a case where paper setting is "plain paper" is set to be 200 mm/s, and the image forming speed employed in a case where paper setting is "heavy paper" is set to be 150 mm/s. In other words, in the case of heavy paper, image formation is performed at a lower speed than in the case of plain paper. Moreover, the image forming speed employed in a case where paper setting is "overhead transparency (OHT) sheet" is set to be 100 mm/s, which is lower than that in the case of heavy paper.

In the present exemplary embodiment, the speed coefficient employed in a case where paper setting is "plain paper" is set to be 1.00. On the other hand, the speed coefficient employed in a case where paper setting is "heavy paper" is set to be 0.75 based on the speed ratio of the image forming speed for heavy paper to the image forming speed for plain paper (150 [mm/s]/200 [mm/s]). Similarly, the speed coefficient employed in a case where paper setting is "OHT sheet" is set to be 0.50 based on the speed ratio of the image forming speed for OHT sheet to the image forming speed for plain paper (100 [mm/s]/200 [mm/s]).

Accordingly, in a case where image formation has been performed on 100 sheets with respect to one side of plain paper, the count value becomes 100. On the other hand, in a case where image formation has been performed on 100 sheets with respect to one side of heavy paper, due to being multiplied by the speed coefficient of 0.75, the count value becomes 75. Moreover, in a case where image formation has been performed on 100 sheets with respect to one side of OHT sheet, due to being multiplied by the speed coefficient of 0.50, the count value becomes 50.

The speed calculation unit 93 calculates a count calculated value by multiplying the count value by the speed coefficient, and outputs the count calculated value to the engine control unit 74.

In a case where the cleaning setting value which has been set by, for example, the operator is 1,000, the engine control unit 74 outputs a cleaning execution instruction to the cleaning control unit 75 when the count calculated value has reached 1,000.

Since, as mentioned above, the speed coefficient varies depending on the type of a recording medium, the actual number of image-formed sheets on which image formation has been performed with respect to each recording medium until the count calculated value reaches the cleaning setting value differs between a case where image formation has been performed on only plain paper and a case where image formation has been performed on only heavy paper. In other words, the number of image-formed sheets (allowable number of sheets) which is allowable during a period from when the previous cleaning operation was performed to when a next cleaning operation is performed is larger in a case where image formation has been performed on only plain paper than in a case where image formation has been performed on only heavy paper. Accordingly, even when a case where image formation has been performed on only plain paper and a case where image formation has been performed on heavy paper and plain paper are compared with each other, the number of image-formed sheets which is allowed until a next cleaning operation is performed (allowable number of sheets) is larger in a case where image formation has been performed on only plain paper.

Figure 7:
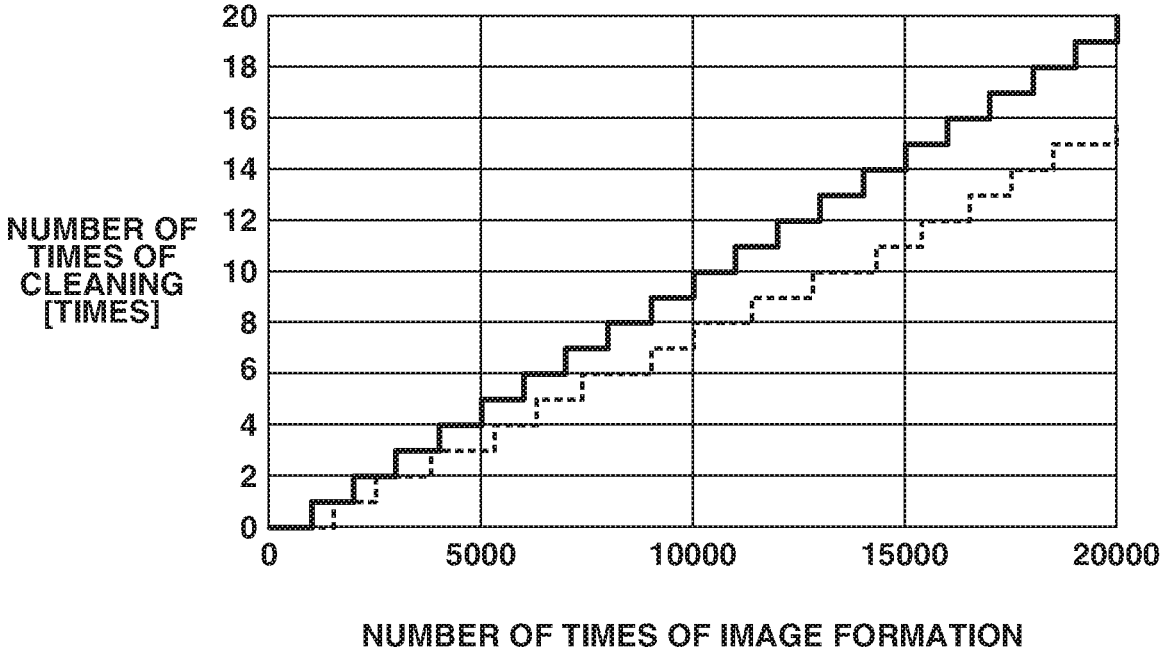
FIG. 7 is a graph illustrating a relationship between the number of times of image formation and the number of times of cleaning.

FIG. 7 is a graph illustrating a relationship between the number of image-formed sheets and the number of times of cleaning. In FIG. 7, a solid line portion indicates an example of the number of times of cleaning performed when image formation is performed on only plain paper, and a dashed line portion indicates an example of the number of times of cleaning performed when image formation is performed on only heavy paper.

As illustrated in FIG. 7, the number of times of cleaning is smaller in the case of heavy paper, for which the image forming speed is low, than in the case of plain paper, for which the image forming speed is high.

For example, in a case where the cleaning setting value (the allowable number of sheets for which image formation is allowable during a period from when the previous cleaning operation was performed to when a next cleaning operation is performed) is 1,000, the cleaning operation is performed 10 times until one-sided printing on only plain paper with A4 size is performed on 10,000 sheets. On the other hand, the cleaning operation is performed 7 times until one-sided printing on only heavy paper with A4 size is performed on 10,000 sheets.

In this way, varying the speed coefficient depending on the type of a recording medium enables performing a cleaning operation at more appropriate timing. Thus, an interval between cleaning operations is made shorter in a case where the image forming speed is high, which is likely to cause a state in which toner is likely to scatter, than in a case where the image forming speed is low.

In this way, even when image formation is performed on the same number of sheets, varying the speed coefficient depending on the type of a recording medium (or the image forming speed therefor) causes a substantial change in the interval at which the cleaning operation is performed. More specifically, in a case where the image forming speed is high, the interval at which the cleaning operation is performed becomes shorter, i.e., the frequency at which the cleaning operation is performed becomes higher, than in a case where the image forming speed is low.

Therefore, even in a situation in which toner is likely to scatter due to the image forming speed being high, it is possible to appropriately perform a cleaning operation. Moreover, in a case where the image forming speed is low, it is possible to prevent an unnecessary cleaning operation from being performed.

Figure 8:
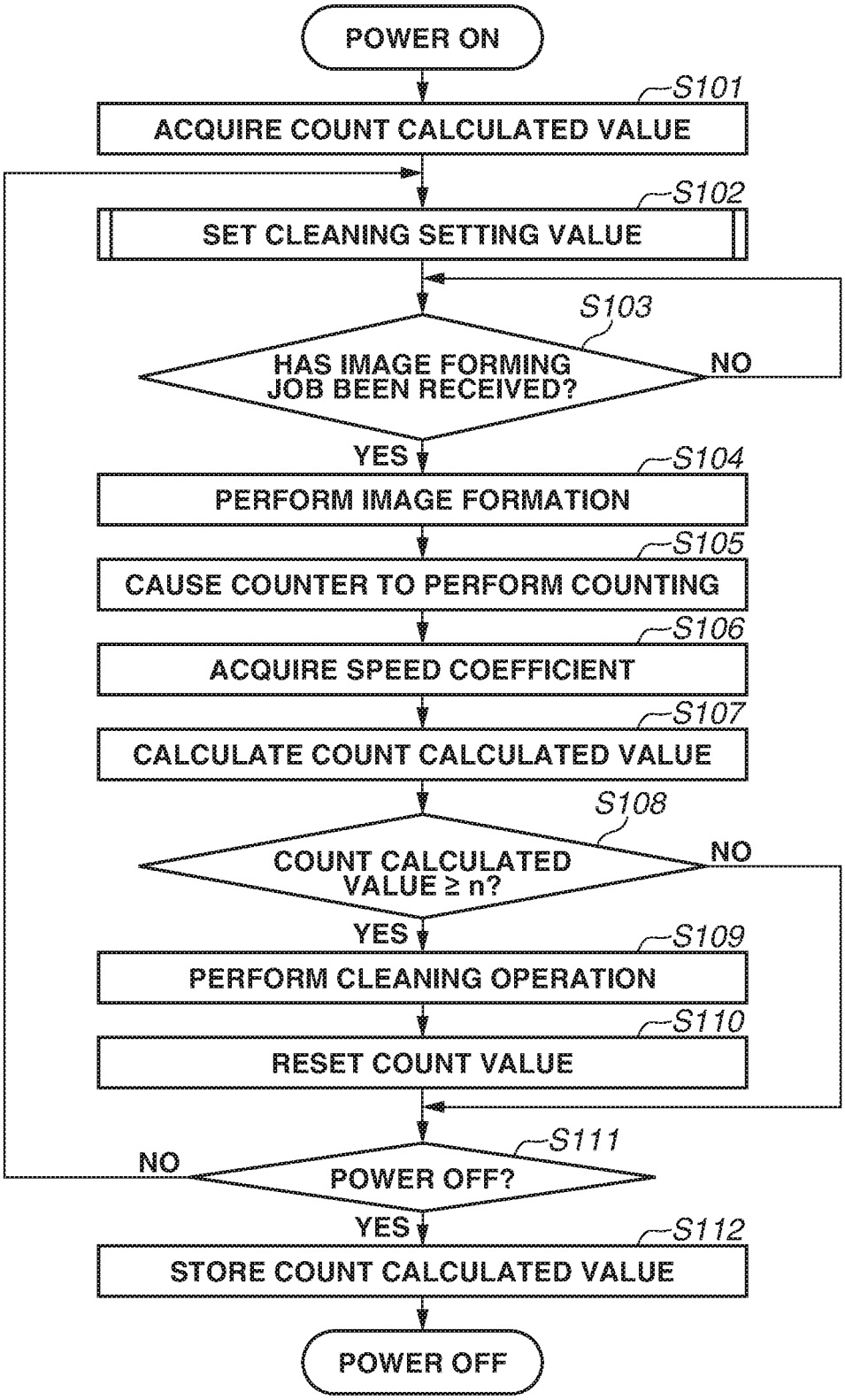
FIG. 8 is a flowchart illustrating a sequence which is performed at the time of execution of an image forming job in a first exemplary embodiment.

Next, control which is performed by the engine control unit 74 included in the IC controller 73 in the cleaning operation according to the present exemplary embodiment is described with reference to the flowchart of FIG. 8.

First, in step S101, the engine control unit 74 acquires a count calculated value from the RAM 501. Then, in step S102, the engine control unit 74 performs setting of the cleaning setting value.

Figure 9:
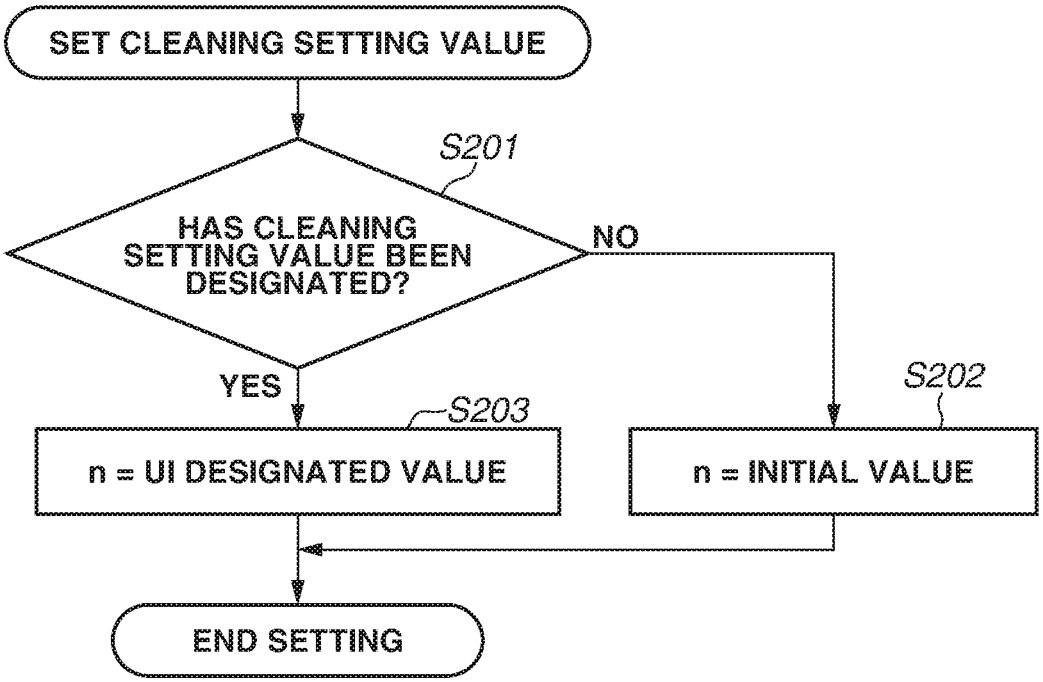
FIG. 9 is a flowchart illustrating a method of setting a cleaning setting value.

FIG. 9 is a flowchart illustrating a method of setting the cleaning setting value in step S102. Here, in step S201, the engine control unit 74 determines whether the cleaning setting value has been designated by the operator via, for example, the user interface 71, and, if it is determined that the cleaning setting value has not been designated (NO in step S201), then, in step S202, the engine control unit 74 sets the cleaning setting value to an initial value and stores the set cleaning setting value in the RAM 501. Here, the initial value is set to, for example, a value of 1,000.

On the other hand, if it is determined that the cleaning setting value has been designated by the operator (YES in step S201), then in step S203, the engine control unit 74 stores the value designated via the user interface 71 in the RAM 501, and then ends the flow illustrated in FIG. 9.

Next, in step S103, the engine control unit 74 determines whether an image forming job has been received from the operator via, for example, the operation unit 304. If, in step S103, it is determined that no image forming job has been received (NO in step S103), the engine control unit 74 repeats determination in step S103, and, if it is determined that an image forming job has been received (YES in step S103), the engine control unit 74 advances the processing to step S104.

Next, in step S104, the engine control unit 74 performs an image forming operation corresponding to the image forming job received in step S103, and, after that, in step S105, the engine control unit 74 causes the count unit 81 to perform counting by an increase of the number of sheets on which image formation has been performed.

Then, in step S106, the engine control unit 74 acquires a speed coefficient corresponding to the image forming speed included in the image forming job received in step S103, and then in step S107, the engine control unit 74 calculates a count calculated value by multiplying the count value obtained in the increased counting in step S105 by the speed coefficient and adding the thus-multiplied count value to the count calculated value read out in step S101.

In step S108, the engine control unit 74 compares the cleaning setting value stored in the RAM 501 in step S102 with the count calculated value calculated in step S107, and, if it is determined that the count calculated value is less than the cleaning setting value (NO in step S108), the engine control unit 74 advances the processing to step S111. Moreover, if it is determined that the count calculated value calculated in step S107 has become greater than or equal to the cleaning setting value (YES in step S108), then in step S109, the engine control unit 74 causes the cleaning control unit 75 to perform a cleaning operation, which may be called laser scanner unit (LSU) cleaning.

Next, in step S110, the engine control unit 74 resets the count value to be obtained by the count unit 81. Furthermore, in the present exemplary embodiment, the count value obtained after being reset is assumed to be 0, but does not need to be limited to this numerical value as long as a configuration in which the count calculated value is subjected to subtraction after a cleaning operation is performed is employed.

Then, in step S111, the engine control unit 74 determines whether to power off the image forming apparatus 1. If it is determined not to power off the image forming apparatus 1 (NO in step S111), the engine control unit 74 returns the processing to step S102, thus repeating the above-described flow. If it is determined to power off the image forming apparatus 1 (YES in step S111), then in step S112, the engine control unit 74 stores the count calculated value calculated in step S107 in the RAM 501, and then ends the cleaning operation in the flowchart of FIG. 8.

As described above, varying a speed coefficient by which to multiply the count value depending on the type of a recording medium enables varying an interval of cleaning according to the image forming speed of the image forming apparatus 1. Therefore, it is possible to perform a cleaning operation for the optical scanning device 40 at appropriate timing while reducing a downtime.

While, in the above description, a configuration in which respective different speed coefficients are set for three types, plain paper, heavy paper, and OHT sheet, is employed, further different speed coefficients can be set for other types of recording media. Moreover, while a configuration in which the speed coefficient is changed according to the type of a recording medium is employed, a configuration in which, in a case where the image forming speed is varied depending on the size of a recording medium, the speed coefficient is changed according to the size of a recording medium can be employed.

Moreover, while, in the above description, respective different speed coefficients are set according to types of recording media, a configuration in which the count value itself is varied according the type of a recording medium can be employed.

Moreover, in a case where, for example, the operator is allowed to select an image quality as setting of the image forming job and the image forming speed is varied according to the selected image quality, a configuration in which the speed coefficient differs according to the image forming speed as with the type of a recording medium as mentioned above can also be employed. At this time, since, in a high image quality mode, the image quality is increased by making the image forming speed lower than in a low image quality mode, the speed coefficient is made larger in the low image quality mode than in the high image quality mode. Here, the high image quality mode is an example of a first image forming mode, and the low image quality mode is an example of a second image forming mode.

Furthermore, a configuration in which the speed coefficient is changed when the image forming speed is changed due to a factor other than the type of a recording medium and the image quality can be employed.

Moreover, in a case where the image forming speed differs according to the type of a recording medium or the mode of image quality, as long as a configuration in which the timing of execution of a cleaning operation is able to be changed according to the image forming speed is employed, not a configuration in which the count method is changed according to the image forming speed but a configuration in which the cleaning setting value is changed according to the image forming speed can be employed. Even in this configuration, it becomes possible to perform a cleaning operation at more appropriate timing according to the image forming speed.

In the above-described first exemplary embodiment, the timing of execution of a cleaning operation is determined according to the image forming speed. In a second exemplary embodiment of the disclosure, the timing of execution of a cleaning operation is determined not only according to the image forming speed but also according to whether the image forming job is continuous. Furthermore, in the second exemplary embodiment, constituent elements similar to those in the first exemplary embodiment are assigned the respective same reference characters, and are omitted from description here.

Figure 10:
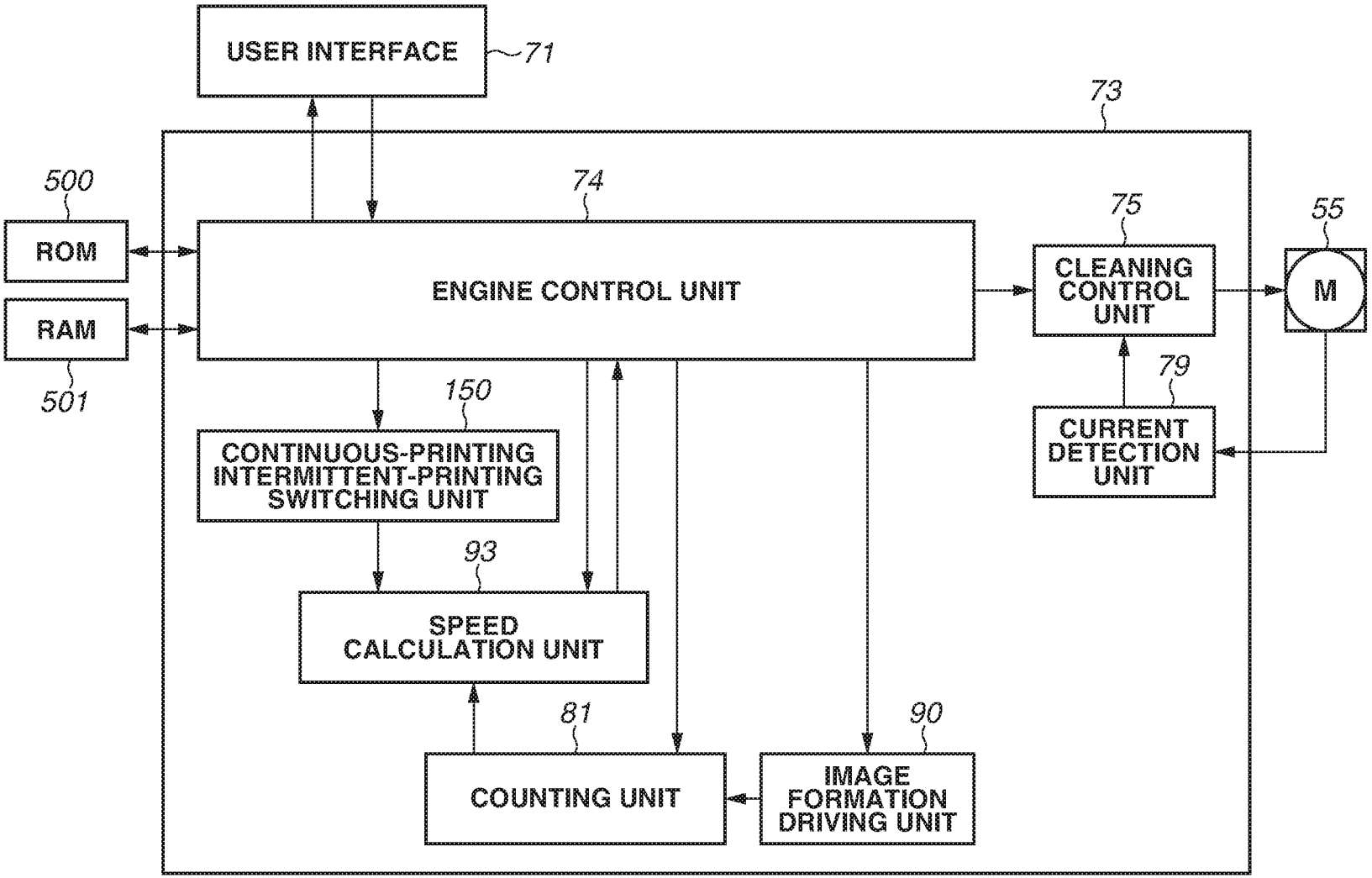
FIG. 10 is a control block diagram illustrating a configuration for performing a cleaning operation in a second exemplary embodiment.

FIG. 10 is a control block diagram illustrating a control configuration for performing a cleaning operation in the second exemplary embodiment.

In the second exemplary embodiment, the IC controller 73 includes, as built-in modules, in addition to the constituent elements described in the first exemplary embodiment, a continuous-printing intermittent-printing switching unit 150, which switches speed coefficients according to which of continuous printing or intermittent printing is selected. Here, continuous printing is a mode of continuously performing image formation on a plurality of sheets of recording medium, and intermittent printing is a mode of performing image formation on only one sheet of recording medium.

Table 2 shows an example of continuous-printing intermittent-printing coefficients, which are output from the continuous-printing intermittent-printing switching unit 150. Such continuous-printing intermittent-printing coefficients are previously stored in, for example, the RAM 501.

TABLE 2

| Printing interval | Continuous-printing intermittent-printing coefficient |
|---|---|
| Continuous printing | 1.00 |
| Intermittent printing | 0.60 |

Table 2 shows values of continuous-printing intermittent-printing coefficients which are set when the image forming apparatus 1 performs image formation with the image forming interval varied. In the second exemplary embodiment, in the case of performing a job for intermittent printing, the interval of cleaning is set longer than in the case of performing a job for continuous printing. This is because, in the case of continuously performing image formation, the amount of scattering of toner tends to become larger according to an environment, such as vibration or static electricity, in the image forming apparatus 1 than in the case of performing image formation on only one sheet.

Accordingly, in the second exemplary embodiment, if the continuous-printing intermittent-printing coefficient for "continuous printing" is set to be "1.00", the continuous-printing intermittent-printing coefficient for "intermittent printing" is set to be "0.60" based on the ratio of the printing interval of "intermittent printing" to the printing interval of "continuous printing".

For example, when the image forming units 10 have performed image formation on 100 sheets with intermittent printing, the count value obtained by the count unit 81 becomes "100". The speed calculation unit 93 multiplies the count value by the continuous-printing intermittent-printing coefficient, thus calculating a count calculated value of "60" (=100×0.60), and outputs the count calculated value to the engine control unit 74.

In a case where the cleaning setting value is set to "1,000" images, the engine control unit 74 outputs a cleaning execution instruction to the cleaning control unit 75 each time the count calculated value reaches "1,000".

Moreover, the speed calculation unit 93 calculates, as a correction coefficient for the count value, the speed coefficient determined according to the image forming speed or the continuous-printing intermittent-printing coefficient output from the continuous-printing intermittent-printing switching unit 150, whichever is greater.

The continuous-printing intermittent-printing switching unit 150 generates a continuous-printing intermittent-printing coefficient signal, which serves as a coefficient corresponding to continuous printing or intermittent printing, according to a continuous-printing intermittent-printing coefficient mode signal corresponding to the image forming job output from the engine control unit 74. Additionally, the speed calculation unit 93 sets a result obtained by multiplying the count value output from the count unit 81 by the correction coefficient as a count calculated value, and outputs the count calculated value to the engine control unit 74.

The engine control unit 74 compares the count calculated value and the cleaning setting value stored in the RAM 501 with each other, and, if the count calculated value coincides with the cleaning setting value, the engine control unit 74 outputs a cleaning execution instruction to the cleaning control unit 75, thus performing a cleaning operation.

Figure 11:
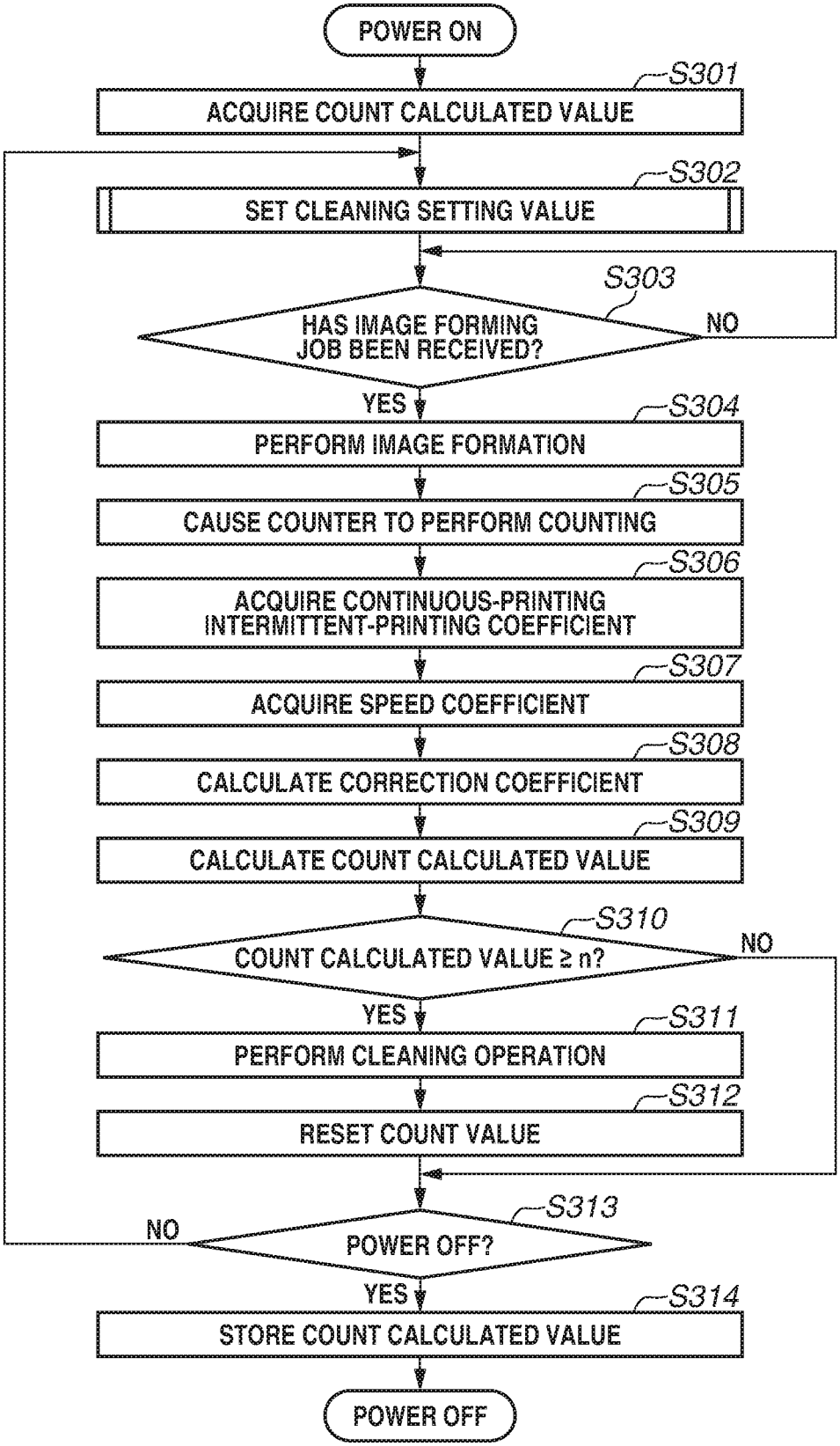
FIG. 11 is a flowchart illustrating a sequence which is performed at the time of execution of an image forming job in the second exemplary embodiment.

Next, control which is performed by the engine control unit 74 included in the IC controller 73 in the cleaning operation according to the second exemplary embodiment is described with reference to the flowchart of FIG. 11.

First, in step S301, the engine control unit 74 acquires a count calculated value from the RAM 501. Then, in step S302, the engine control unit 74 performs setting of the cleaning setting value. Furthermore, setting of the cleaning setting value which is performed in step S302 is similar to the control operation illustrated in FIG. 9, and is, therefore, omitted from description here.

After setting the cleaning setting value, then in step S303, the engine control unit 74 determines whether an image forming job has been received. If, in step S303, it is determined that no image forming job has been received (NO in step S303), the engine control unit 74 repeats determination in step S303, and, if it is determined that an image forming job has been received (YES in step S303), the engine control unit 74 advances the processing to step S304.

Next, in step S304, the engine control unit 74 performs an image forming operation corresponding to the image forming job received in step S303, and, after that, in step S305, the engine control unit 74 causes the count unit 81 to perform counting by an increase of the number of sheets on which image formation has been performed.

Then, in step S306 and step S307, the engine control unit 74 acquires a continuous-printing intermittent-printing coefficient and a speed coefficient, respectively, and then in step S308, the engine control unit 74 calculates a correction coefficient. At this time, in step S308, the engine control unit 74 calculates, as a correction coefficient, the continuous-printing intermittent-printing coefficient or the speed coefficient, whichever is greater.

Then, in step S309, the engine control unit 74 calculates a count calculated value by adding together a value obtained by multiplying the count value in step S305 by the correction coefficient calculated in step S308 and the count calculated value acquired in step S301.

Then, in step S310, the engine control unit 74 compares the cleaning setting value stored in the RAM 501 with the count calculated value calculated in step S309. If it is determined that the count calculated value calculated in step S309 is less than the cleaning setting value (NO in step S310), the engine control unit 74 advances the processing to step S313. If it is determined that the count calculated value calculated in step S309 is greater than or equal to the cleaning setting value (YES in step S310), then in step S311, the engine control unit 74 causes the cleaning control unit 75 to perform a cleaning operation.

Next, in step S312, upon completion of the cleaning operation described above, the engine control unit 74 resets the count value to be obtained by the count unit 81. Furthermore, in the second exemplary embodiment, the count value obtained after being reset is assumed to be 0, but does not need to be limited to this numerical value as long as a configuration in which the count calculated value is subjected to subtraction after a cleaning operation is performed is employed.

Then, in step S313, the engine control unit 74 determines whether to power off the image forming apparatus 1. If it is determined not to power off the image forming apparatus 1 (NO in step S313), the engine control unit 74 returns the processing to step S302, thus repeating the above-described flow. If it is determined to power off the image forming apparatus 1 (YES in step S313), then in step S314, the engine control unit 74 stores the count calculated value calculated in step S309 in the RAM 501, and then ends the cleaning operation in the flowchart of FIG. 9.

As described above, varying the interval of cleaning according to not only the image forming speed of the image forming apparatus 1 but also the image forming interval enables implementing cleaning of the optical scanning device 40 at more appropriate timing.

Furthermore, while the second exemplary embodiment has no mention of the paper size for use in image formation, in the case of a configuration in which the image forming speed is changed according to the paper size, a configuration in which the speed coefficient is changed according to the paper size can be employed.

Moreover, in step S308, instead of setting, as a correction coefficient, the speed coefficient or the continuous-printing intermittent-printing coefficient, whichever is greater, a value obtained by adding together the speed coefficient and the continuous-printing intermittent-printing coefficient can be set as a correction coefficient. Even this configuration enables performing an appropriate cleaning operation corresponding to both the image forming speed and the printing interval.

In the above-described first exemplary embodiment, the timing of execution of a cleaning operation is determined according to the image forming speed. In a third exemplary embodiment of the disclosure, the timing of execution of a cleaning operation is determined not only according to the image forming speed but also in consideration of the internal temperature of the image forming apparatus 1. Furthermore, in the third exemplary embodiment, constituent elements similar to those in the first exemplary embodiment are assigned the respective same reference characters, and are omitted from description here.

Figure 12:
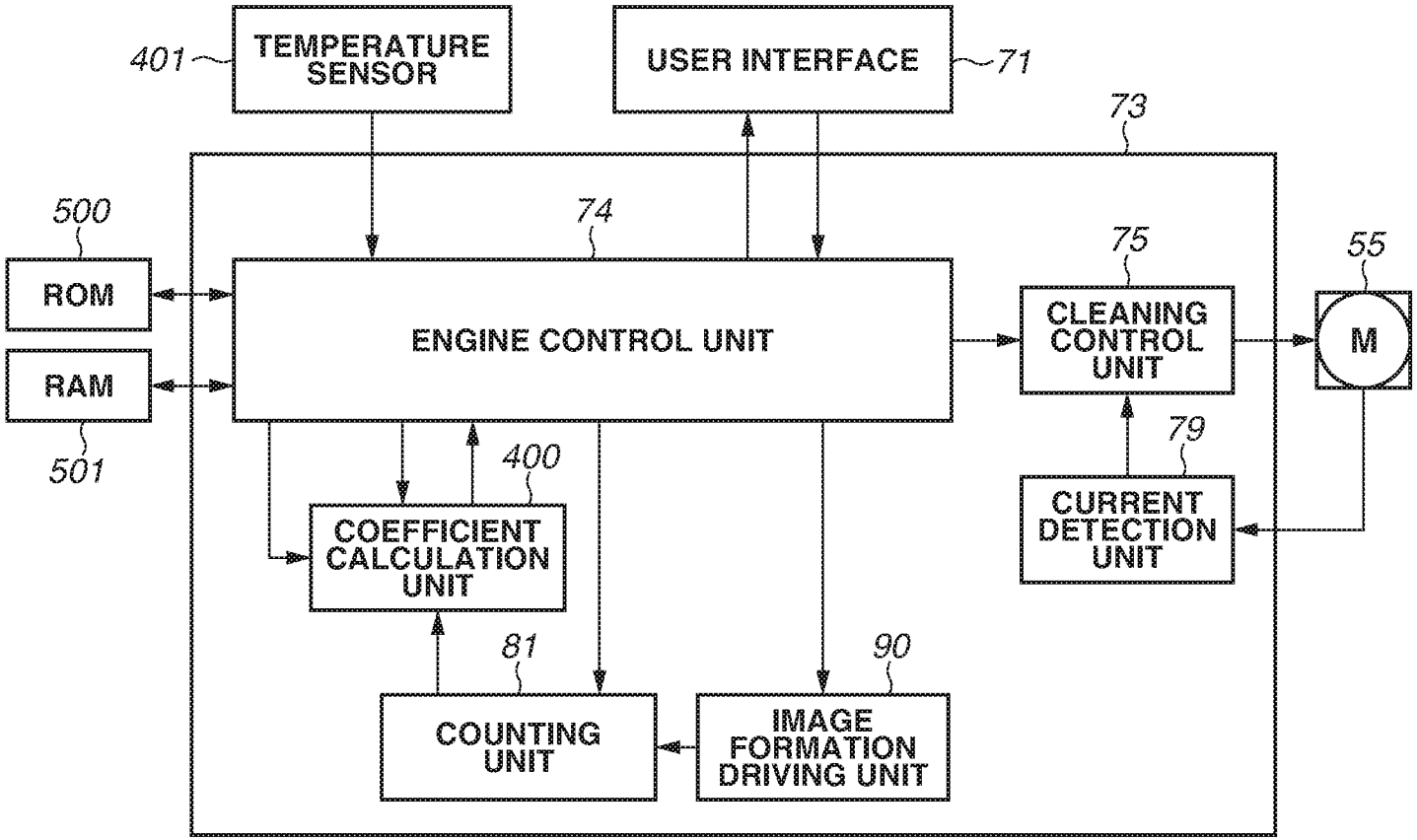
FIG. 12 is a control block diagram illustrating a configuration for performing a cleaning operation in a third exemplary embodiment.

FIG. 12 is a control block diagram illustrating a control configuration for performing a cleaning operation in the third exemplary embodiment.

In the third exemplary embodiment, the IC controller 73 includes, as a built-in module, a coefficient calculation unit 400 instead of the speed calculation unit 93 described in the first exemplary embodiment. Moreover, a temperature sensor 401, which is included in the image forming apparatus 1 to detect an environment in the image forming apparatus 1, is connected to the engine control unit 74, and the engine control unit 74 acquires a result of detection performed by the temperature sensor 401 and then outputs a temperature coefficient to the coefficient calculation unit 400.

Table 3 shows values of temperature coefficients which are changed according to the temperature inside the image forming apparatus 1. Such temperature coefficients are set according to the temperature inside the image forming apparatus 1, which varies depending on, for example, the installation location of the image forming apparatus 1 or the season. Furthermore, the temperature coefficient is a numerical value which is affected by, for example, the configuration of the image forming apparatus 1 and can be set as appropriate. Moreover, while, in the third exemplary embodiment, the temperature sensor 401 is used as a detection unit which detects the temperature inside the image forming apparatus 1, for example, a humidity sensor can be used in place of the temperature sensor 401 or both a temperature sensor and a humidity sensor can be used in combination.

TABLE 3

| Temperature | Temperature coefficient |
|---|---|
| 10° C. | 2.00 |
| 20° C. | 1.50 |
| 30° C. | 1.00 |
| 40° C. | 0.80 |
| 50° C. | 0.60 |

The coefficient calculation unit 400 calculates, as a correction coefficient, a speed coefficient signal or a temperature coefficient signal output from the engine control unit 74, whichever is greater. Then, the coefficient calculation unit 400 sets a result obtained by multiplying the count value output from the count unit 81 by the correction coefficient as a count calculated value, and then outputs the count calculated value to the engine control unit 74.

The engine control unit 74 compares the count calculated value with the cleaning setting value previously stored in the RAM 501, and, if the count calculated value coincides with the cleaning setting value stored in the RAM 501, the engine control unit 74 outputs a cleaning execution instruction to the cleaning control unit 75, thus performing a cleaning operation.

For example, in a case where the image forming speed is a speed corresponding to "plain paper", when the temperature inside the image forming apparatus 1 is 40° C. and the image forming units 10 have performed image formation on 100 sheets of recording medium, the count value becomes "100". Then, the coefficient calculation unit 400 multiplies the count value by the temperature coefficient, thus calculating a count calculated value of "80" (=100×0.80), and outputs the count calculated value to the engine control unit 74.

When the cleaning setting value is set to be "1,000", the engine control unit 74 outputs a cleaning execution instruction to the cleaning control unit 75 each time the count calculated value reaches "1,000".

At this time, in a case where the image forming speed is a speed corresponding to "plain paper", when the temperature inside the image forming apparatus 1 is 30° C. and the image forming units 10 have performed image formation on plain paper, the speed coefficient signal is "1.00" and the temperature coefficient is "1.00", so that the count calculated value obtained when the count value is "1,000" becomes "1,000" (=1000×1.00×1.00).

Moreover, in a case where the temperature inside the image forming apparatus 1 is "10° C." to "50° C." when image formation has been performed on "1,000" sheets of plain paper, the speed coefficient is "1.00" and the temperature coefficient varies in the range of "2.00" to 0.60". Therefore, depending on the temperature inside the image forming apparatus 1, the engine control unit 74 performs a cleaning operation after the number of image-formed sheets exceeds 1,000 or performs a cleaning operation before the number of image-formed sheets reaches 1,000. This is because, in a case where image formation has been performed on a recording medium when the temperature inside the image forming apparatus 1 is low, the amount of scattering of toner is likely to become large.

Figure 13:
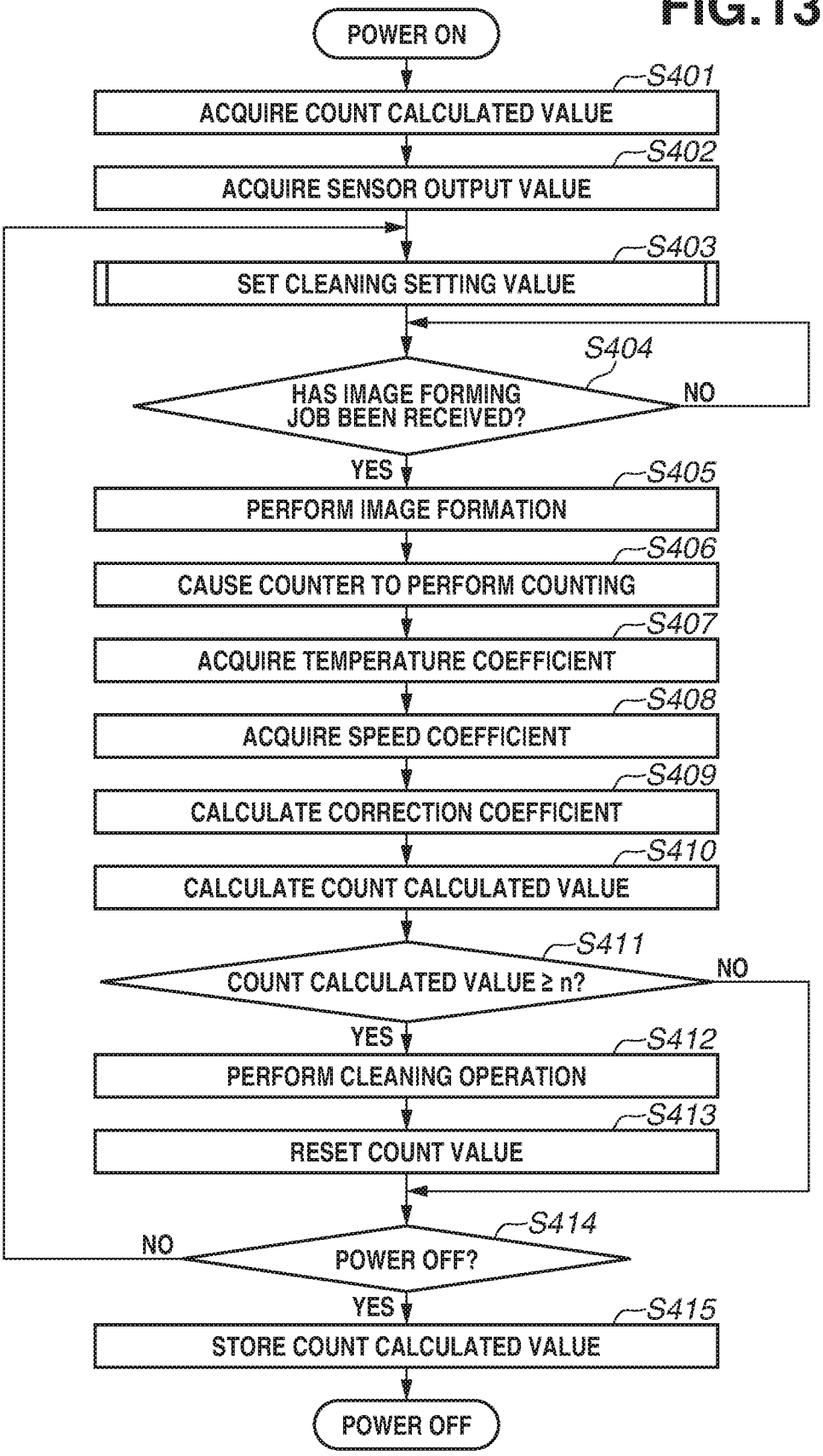
FIG. 13 is a flowchart illustrating a sequence which is performed at the time of execution of an image forming job in the third exemplary embodiment.

Next, control which is performed by the engine control unit 74 included in the IC controller 73 in the cleaning operation according to the third exemplary embodiment is described with reference to the flowchart of FIG. 13.

First, in step S401, the engine control unit 74 acquires a count calculated value from the RAM 501, and then in step S402, the engine control unit 74 acquires a result of detection performed by the temperature sensor 401.

Then, in step S403, the engine control unit 74 performs setting of the cleaning setting value. Furthermore, setting of the cleaning setting value which is performed in step S403 is similar to the control operation illustrated in FIG. 9, and is, therefore, omitted from description here.

Next, in step S404, the engine control unit 74 determines whether an image forming job has been received from the operator via, for example, the operation unit 304. If, in step S404, it is determined that no image forming job has been received (NO in step S404), the engine control unit 74 repeats determination in step S404, and, if it is determined that an image forming job has been received (YES in step S404), the engine control unit 74 advances the processing to step S405.

Then, in step S405, the engine control unit 74 performs an image forming operation corresponding to the image forming job, and, after that, in step S406, the engine control unit 74 causes the count unit 81 to perform counting by an increase of the number of sheets on which image formation has been performed.

Then, in step S407 and step S408, the engine control unit 74 acquires a temperature coefficient and a speed coefficient, respectively, and then in step S409, the engine control unit 74 calculates a correction coefficient. At this time, in step S409, the engine control unit 74 calculates, as a correction coefficient, the temperature coefficient or the speed coefficient, whichever is greater.

Then, in step S410, the engine control unit 74 calculates a count calculated value by adding together a value obtained by multiplying the count value in step S406 by the correction coefficient calculated in step S409 and the count calculated value acquired in step S401.

Then, in step S411, the engine control unit 74 compares the cleaning setting value stored in the RAM 501 with the count calculated value calculated in step S410, and, if it is determined that the count calculated value is less than the cleaning setting value (NO in step S411), the engine control unit 74 advances the processing to step S414. If it is determined that the count calculated value is greater than or equal to the cleaning setting value (YES in step S411), then in step S412, the engine control unit 74 causes the cleaning control unit 75 to perform a cleaning operation.

Next, in step S413, upon completion of the cleaning operation described above, the engine control unit 74 resets the count value to be obtained by the count unit 81. Furthermore, in the present exemplary embodiment, the count value obtained after being reset is assumed to be 0, but does not need to be limited to this numerical value as long as a configuration in which the count calculated value is subjected to subtraction after a cleaning operation is performed is employed.

Then, in step S414, the engine control unit 74 determines whether to power off the image forming apparatus 1. If it is determined not to power off the image forming apparatus 1 (NO in step S414), the engine control unit 74 returns the processing to step S403, thus repeating the above-described flow. On the other hand, if it is determined to power off the image forming apparatus 1 (YES in step S414), then in step S415, the engine control unit 74 stores the count calculated value calculated in step S410 in the RAM 501, and then ends the cleaning operation in the flowchart of FIG. 13.

As described above, varying the interval of cleaning according to not only the image forming speed of the image forming apparatus 1 but also the temperature inside the image forming apparatus 1 enables implementing cleaning of the optical scanning device 40 at more appropriate timing.

Moreover, in step S409, instead of setting, as a correction coefficient, the speed coefficient or the temperature coefficient, whichever is greater, a value obtained by adding together the speed coefficient and the temperature coefficient can be set as a correction coefficient. Even this configuration enables performing an appropriate cleaning operation corresponding to both the image forming speed and the temperature inside the image forming apparatus 1.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-177522 filed Sep. 21, 2018, which is hereby incorporated by reference herein in its entirety.

What is claimed is:

1. An image forming apparatus comprising:

an image forming unit including a photosensitive member, a scanning device including a transparent member which allows laser light for scanning the photosensitive member to pass therethrough outward, and a sleeve which develops, with toner, an electrostatic latent image formed on the photosensitive member scanned by the laser light into a toner image, and configured to form an image on a recording medium by transferring the toner image to the recording medium, the image forming unit performing image formation on the recording medium in a first mode in which image formation is performed with a rotational speed of the photosensitive member set to a first speed or in a second mode in which image formation is performed with the rotational speed of the photosensitive member set to a second speed higher than the first speed;

a cleaning mechanism configured to clean the transparent member;

a counter configured to count a number of image-formed sheets, which are sheets of the recording medium on which images have been formed by the image forming unit; and a control unit configured to, in a case where the image forming unit performs image formation in the first mode, control the cleaning mechanism to clean the transparent member in response to the number of image-formed sheets counted by the counter reaching a first predetermined number of sheets, and, in a case where the image forming unit performs image formation in the second mode, control the cleaning mechanism to clean the transparent member in response to the number of image-formed sheets counted by the counter reaching a second predetermined number of sheets smaller than the first predetermined number of sheets.

2. The image forming apparatus according to claim 1, wherein the image forming unit is able to form an image on a first recording medium or a second recording medium which is smaller in grammage than the first recoding medium, and is configured to form an image in the first mode when performing image formation on the first recording medium, and to form an image in the second mode when performing image formation on the second recording medium.

3. The image forming apparatus according to claim 1, further comprising a sensor configured to detect a temperature inside the apparatus, wherein, in a case where a result of detection performed by the sensor is a second temperature higher than a first temperature, the counter performs counting with a count value smaller than that in a case where the result of detection is the first temperature.

4. The image forming apparatus according to claim 1, wherein, after causing the cleaning mechanism to operate and complete cleaning of the transparent member, the control unit resets a count value of the counter.

5. An image forming apparatus comprising:

An image forming unit including a photosensitive member, and a scanning device including a transparent member which allows laser light for scanning the photosensitive member to pass therethrough outward, and configured to form an image on a recording medium by developing, with toner, an electrostatic latent image formed on the photosensitive member scanned by the laser light into a toner image and transferring the toner image to the recording medium, the image forming unit performing image formation on the recording medium in a first mode and a second mode which is lower in image quality than the first mode;

a cleaning mechanism configured to clean the transparent member; and a control unit configured to cause the cleaning mechanism to perform a cleaning operation for the transparent member, when a number of sheets of the recording medium on which image formation is allowed to be performed during a period from when the cleaning mechanism performs a cleaning operation to when the cleaning mechanism performs a next cleaning operation is defined as an allowable number of sheets, the control unit causing the cleaning mechanism to perform a next cleaning operation in response to a number of image-formed sheets, which are sheets of the recording medium on which images have been formed after the cleaning mechanism performs a cleaning operation, reaching the allowable number of sheets, wherein the allowable number of sheets in a case where image formation is performed only in the first mode after the cleaning mechanism performs a cleaning operation is less than the allowable number of sheets in a case where image formation is performed only in the second mode after the cleaning mechanism performs a cleaning operation.

6. The image forming apparatus according to claim 5, further comprising a counter configured to count a number of image-formed sheets, which are sheets of the recording medium on which images have been formed by the image forming unit.

7. The image forming apparatus according to claim 6, further comprising a sensor configured to detect a temperature inside the apparatus, wherein, in a case where a result of detection performed by the sensor is a second temperature higher than a first temperature, the counter performs counting with a count value smaller than that in a case where the result of detection is the first temperature.

8. The image forming apparatus according to claim 6, wherein, after causing the cleaning mechanism to operate and complete cleaning of the transparent member, the control unit resets a count value of the counter.

9. The image forming apparatus according to claim 5, wherein the image forming unit is able to form an image on a first recording medium or a second recording medium which is smaller in grammage than the first recoding medium, and is configured to form an image in the first mode when performing image formation on the first recording medium, and to form an image in the second mode when performing image formation on the second recording medium.

* * * * *